US005356051A

United States Patent [19]

Azuma et al.

[11] Patent Number: 5,356,051

[45] Date of Patent: Oct. 18, 1994

[54] LIQUID SOAP SUPPLYING DEVICE

[75] Inventors: Tsutomu Azuma; Yojiro Taketomi, both of Kitakyushu, Japan

[73] Assignee: Toto, Ltd., Fukuoka, Japan

[21] Appl. No.: 763,522

[22] Filed: Sep. 23, 1991

[51] Int. Cl.[5] ..... B65D 83/00

[52] U.S. Cl. ..... 222/396; 222/401; 222/62

[58] Field of Search ..... 222/396–399, 222/401, 64–69, 62

[56] References Cited

U.S. PATENT DOCUMENTS

| | | | |
|---|---|---|---|
| 3,366,276 | 1/1968 | Fridley | 222/66 X |
| 3,369,717 | 2/1968 | Campbell | 222/399 |
| 3,604,602 | 9/1971 | Lee | 222/399 X |
| 4,284,210 | 8/1981 | Horak | 222/68 X |
| 4,527,714 | 7/1985 | Bowman | 222/64 X |
| 4,531,659 | 7/1985 | Wright . | |
| 4,531,660 | 7/1985 | Ford, Jr. | 222/401 X |
| 4,921,135 | 5/1990 | Pleet | 222/396 X |
| 5,031,834 | 7/1991 | Simpson . | |

FOREIGN PATENT DOCUMENTS

| | | |
|---|---|---|
| 292789 | 7/1990 | Japan . |
| 8807895 | 10/1988 | World Int. Prop. O. . |

*Primary Examiner*—Andres Kashnikow
*Assistant Examiner*—Kenneth DeRosa
*Attorney, Agent, or Firm*—Sandler Greenblum & Bernstein

[57] ABSTRACT

A liquid soap supplying device of the present invention includes a tank for storing liquid soap, a discharging nozzle communicating with the tank through a pipe, a liquid soap supplying device for supplying liquid soap in the tank to the discharging nozzle, an air supplying device communicating with the discharging nozzle through a pipe and a mixing chamber for liquid soap and air arranged in the discharging port of the discharging nozzle. The liquid soap and air supplied under operation of each of the supplying devices are mixed and agitated in the mixing chamber so as to discharge the bubbled liquid soap. A pressuring device communicates with the air accumulation part at an inner upper part in the tank. An air feeding pipe is connected to the air accumulation part, and the liquid soap and air in the tank are fed to the discharging nozzle under an operation of the pressurizing device, wherein a supplying system capable of discharging bubbled liquid soap from a plurality of discharging nozzles can be provided with only one supplying source at a less-expensive cost. Various sensors for sensing pressure in the tank, remaining volume of the liquid soap and an opening or closing of the supplementing port of the tank are arranged, and a control part controls an operation of the pressurizing device in response to a sensing signal from each of these sensors.

2 Claims, 25 Drawing Sheets

SAFETY VALVE IS OPENED
DOES 0.1 SECOND ELAPSE ?
NO
YES
SAFETY VALVE IS CLOSED
COMPRESSOR IS DRIVER
IS AN INNER PRESSURE OF THE TANK 0.5 kgf/cm2 OR LESS ?
NO
YES
DO 5 MINUTE ELAPSE ?
NO
ABNORMAL STATE IS DISPLAYED
COMPRESSOR IS STOPPED
SAFETY VALVE IS OPENED
COMPRESSOR IS STOPPED

LIQUID SOAP SUPPLYING DEVICE

BACKGROUND OF THE INVENTION

1. Field of the Invention

The present invention relates to a liquid soap supplying device for use in washing hands, hair and body and for other desired applications.

2. Description of the Prior Art

In the prior art, it has been known to provide a liquid soap supplying device comprised of a tank for storing liquid soap, a pressurizing device for pressurizing an interior side of the tank and a discharging nozzle communicating with the tank through a liquid soap feeding pipe (for example, see Japanese Utility Model Laid-Open No. Hei 2-92789).

This supplying device feeds liquid soap in a tank by a pressurizing force of a pressurizing device to a discharging nozzle and discharges the liquid soap in a stream-like flow from the discharging port under an opening or closing operation of the discharging nozzle.

In the case of the aforesaid prior art supplying device, if a discharging force for the liquid soap was too strong in response to a certain pressurizing force of the pressurizing device, the liquid soap struck against the hands of a user, splashed and dropped from between the fingers and the device left certain room for improvement in view of an efficient use of the liquid soap.

SUMMARY OF THE INVENTION

The present invention has been invented in view of the above circumstances as found in the prior art, and its first object is to provide a supplying device for use in discharging bubbled liquid soap without forming any splashing and dropping off, even if the liquid soap strikes against the hands.

The second object of the present invention is to prevent liquid soap remaining in a piping communicating with a tank and the discharging nozzle from being fixed in the supplying device of the first object and clogging the piping.

The third object of the present invention is to enable a fine texture of the liquid soap or the like to be optionally adjusted in the supplying device of the aforesaid first object in compliance with a preference of a user.

The fourth object of the present invention is to improve the safety characteristics of the supplying device of the aforesaid first object.

The fifth object of the present invention is to enable an efficient use of liquid soap to be attained when the supplying device of the aforesaid first object is operated or used.

The sixth object of the present invention is to provide a liquid soap supplying device in an apparatus having a plurality of supplying portions for use in discharging bubbled liquid soap in which a remaining amount of liquid soap in each of the tanks at each of the supplying portions can be totally displayed.

The seventh object of the present invention is to enable the supplying device for discharging the aforesaid bubbled liquid soap to be easily mounted in a container, such as a basin already installed.

The aforesaid first object can be attained by constructing the liquid soap supplying device comprising a discharging nozzle having a mixing chamber for liquid soap and air, means for forcibly supplying liquid soap to the discharging nozzle and means for forcibly supplying air to the discharging nozzle. More particularly, this object can be attained by applying a tank for storing liquid soap with an air accumulating part being left at an inner upper part thereof; a pressurizing device mounted to communicate with the aforesaid air accumulating part; a control part for controlling an operation of the pressurizing device in response to a sensing signal from a pressure sensor arranged in the air accumulating part; a liquid soap feeding pipe to be taken out of a bottom part of the aforesaid tank; an air feeding pipe to be taken out of the aforesaid air accumulating part; and a discharging nozzle provided with a mixing chamber for mixing liquid soap and air and arranged to communicate with the liquid soap feeding pipe and the air feeding pipe.

The aforesaid second object can be accomplished by means of mounting a check valve at the upper-most stream side of the liquid soap feeding pipe.

The aforesaid third object can be accomplished by arranging a flow rate adjusting valve for use in adjusting a supplying amount of air to the discharging nozzle at a proper location in the air feeding pipe.

The aforesaid fourth object can be accomplished by means of arranging an emergency stop control means for stopping an operation of the pressurizing device by sensing an abnormal state in a system in the control part.

The fifth object of the present invention can be accomplished by means of a remaining amount sensor for use in performing a step-wise sensing of a remaining amount of liquid soap in the tank and a remaining amount displaying part for use in displaying in a step-wise manner a remaining amount of liquid soap in the tank in response to a sensing signal from the remaining amount sensor of the like.

The sixth object of the present invention can be accomplished by the liquid soap supplying device in which a plurality of liquid soap supplying portions comprised of the aforesaid tank, pressurizing device, controlling part, liquid soap feeding pipe, air feeding pipe, discharging nozzle and remaining amount sensor or the like, are arranged, and also a displaying function part for concentrically displaying a remaining amount of liquid soap within each of the tanks at each of the aforesaid liquid soap supplying device is provided.

The seventh object of the present invention can be accomplished by the liquid soap supplying device comprised of a tank for storing liquid soap, a main body of a water tap having a liquid soap discharging port, a liquid soap pump for feeding liquid soap in the tank to the liquid soap discharging port, an air pump for feeding air to the liquid soap discharging port and a control part for controlling an operation of each of the liquid soap pump and the air pump, wherein the aforesaid main body of the water tap is provided with two connection ports to be connected to the two fixing ports mounted on an upper surface of a basin which has been already installed. The liquid soap discharging port and the supplied water discharging port are arranged side-by-side, a supplementing pipe for communicating a supplementing port for liquid soap to be mounted at an upper surface side of the basin with the liquid soap tank to be mounted at a lower part of the basin is arranged to be passed through one connection port described above, and both the water supplying pipe and the liquid feeding pipe connected to the liquid soap tank are connected to each of the supplied water discharging port of the main body of the water tap and the liquid soap discharging port through the other connecting port.

BRIEF DESCRIPTION OF THE DRAWINGS

Other objects and features of the present invention will become more apparent from the following description concerning the accompanying drawings.

DESCRIPTION OF THE PREFERRED EMBODIMENTS

Figure 1:
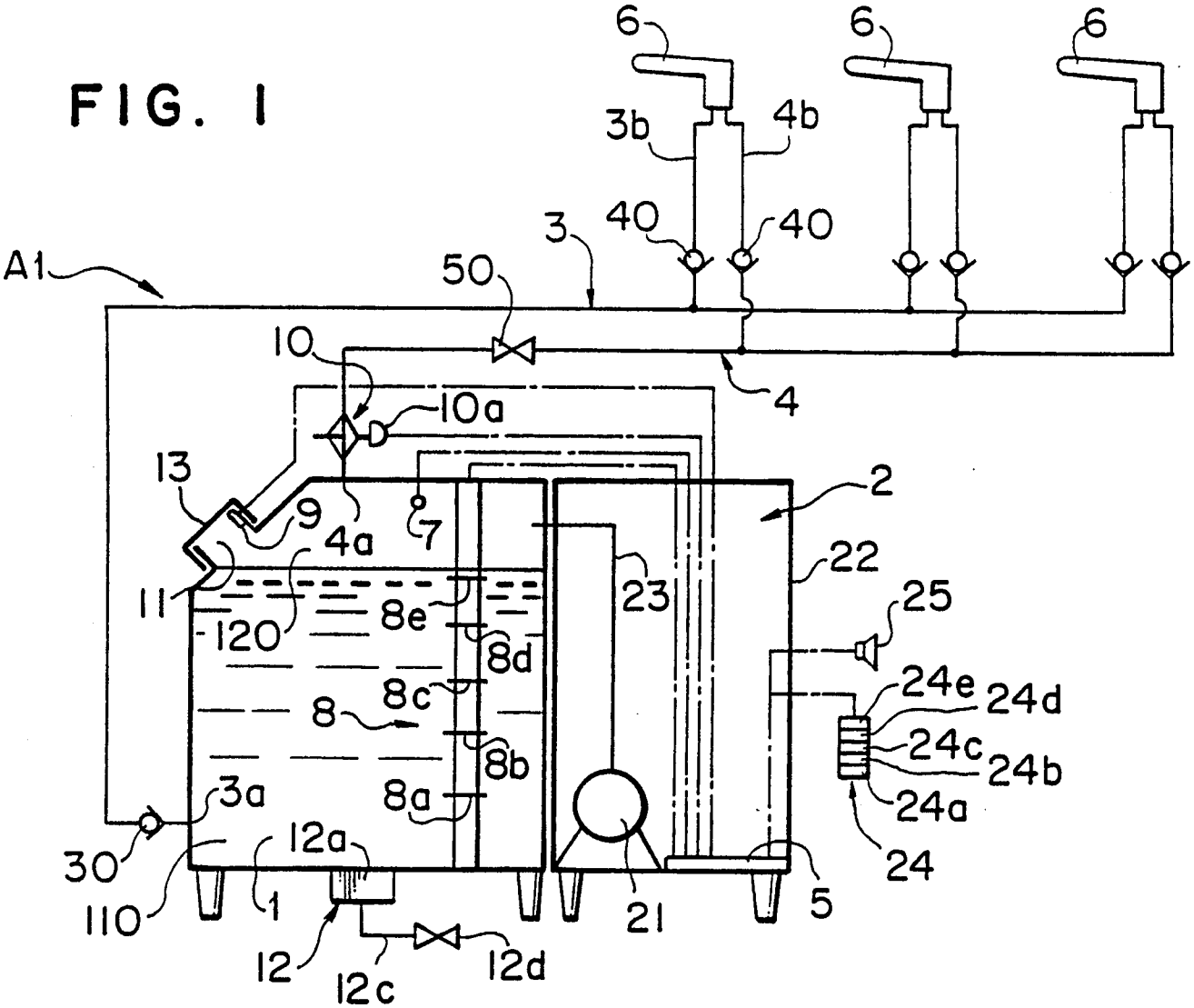
FIG. 1 is a schematic view for showing one preferred embodiment of the liquid soap supplying device of the present invention.
Figure 3:
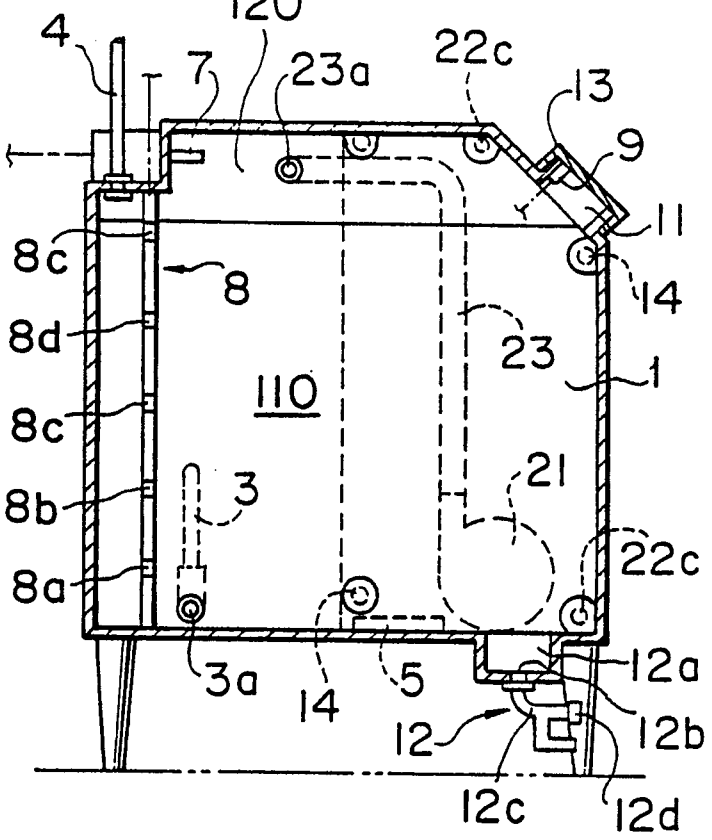
FIG. 3 is a longitudinal side elevation in section for showing a tank.

FIG. 1 shows a liquid soap supplying device A1 comprised of a tank 1, a pressurizing device 2, a liquid soap feeding pipe 3, an air feeding pipe 4, a control part 5 and discharging nozzles 6, or the like, and a basic configuration of the device A1 will be first described.

The tank 1 has an entire shape of a cylinder, a rectangular cylinder, or a spherical shape, or any other optional shape, and its shape is not restricted at all. However, the tank is comprised of a box-like, pressure-proof container, as shown in FIGS. 2 to 5, wherein a liquid soap supplementary port 11 is opened at a middle and higher location in a side wall. The container may accumulate liquid soap 110 with the supplementary port 11 being applied as an upper limit location, and at the same time, an air accumulating part 120 can be kept above the liquid soap 110 and a desired amount of compressed air can be stored there. The supplementary port 11 is closed by a lid 13 in such a way as it may be opened or closed.

A liquid soap discharging port 3*a* is opened at a bottom part of the tank 1 and a base end of the liquid soap feeding pipe 3 is connected to the discharging port 3*a*. An upper part of the tank 1 is provided with an opened air discharging port 4*a* which communicates with the air accumulation port 120, and a base end of the air feeding pipe 4 is connected to the discharging port 4*a*.

A pressure sensor 7 electrically connected to the control part 5 is arranged within the air accumulating part 120, and a compressor 21 for the pressurizing device 2 communicates through an air intake pipe 23.

The pressure sensor 7 is comprised of a well-known pressure switch using either a strain gauge or a magnetic resistance element and transmits pressure with the tank as an electrical signal to the control part 5 by utilizing a variation of an electrical resistance accompanied by a variation of pressure in the tank 1.

The pressurizing device 2 is constructed such that the compressor 21 and the control part 5 are arranged in the casing 22 separately arranged from the tank 1 and it may easily be fixed to several kinds of tanks.

The compressor 21 is electrically connected to the control part 5 and operation of the compressor 21 is controlled by the control part.

The control part 5 is comprised of electrical circuits such as ICs or capacitors, or the like, and is provided with a pressurizing control means for operating the compressor 21 in response to a sensed signal from the pressure sensor 7 when a pressure in the tank becomes less than a low side set pressure $P_1$ (0.3 kgf/cm$^2$ in the preferred embodiment) and stopping the compressor 21 when the pressure in the tank 1 becomes more than a higher side set pressure $P_2$ (0.5 kgf/cm$^2$ in the preferred embodiment). This control part 5 is provided with various control means to be described later.

Although a difference between the aforesaid or later described lower side set pressures $P_1$, $P_4$ and the higher side set pressures $P_2$, $P_3$ are not limited to the numerical values in the preferred embodiments, the difference between $P_1$ and $P_2$ should be set to such a value as on preventing a concurrent use or a continuous use in response to the number of cooperating discharging nozzles 6. The higher set pressure should be set to such a value as one allowed in the tank 1 (a value applying a slight surplus to the tank).

The liquid soap feeding pipe 3 and the air feeding pipe 4 connected to the tank 1 are divided into several segment pipes in the midway parts and then the discharging nozzle 6 is connected to each of the branched pipes.

Figure 6:
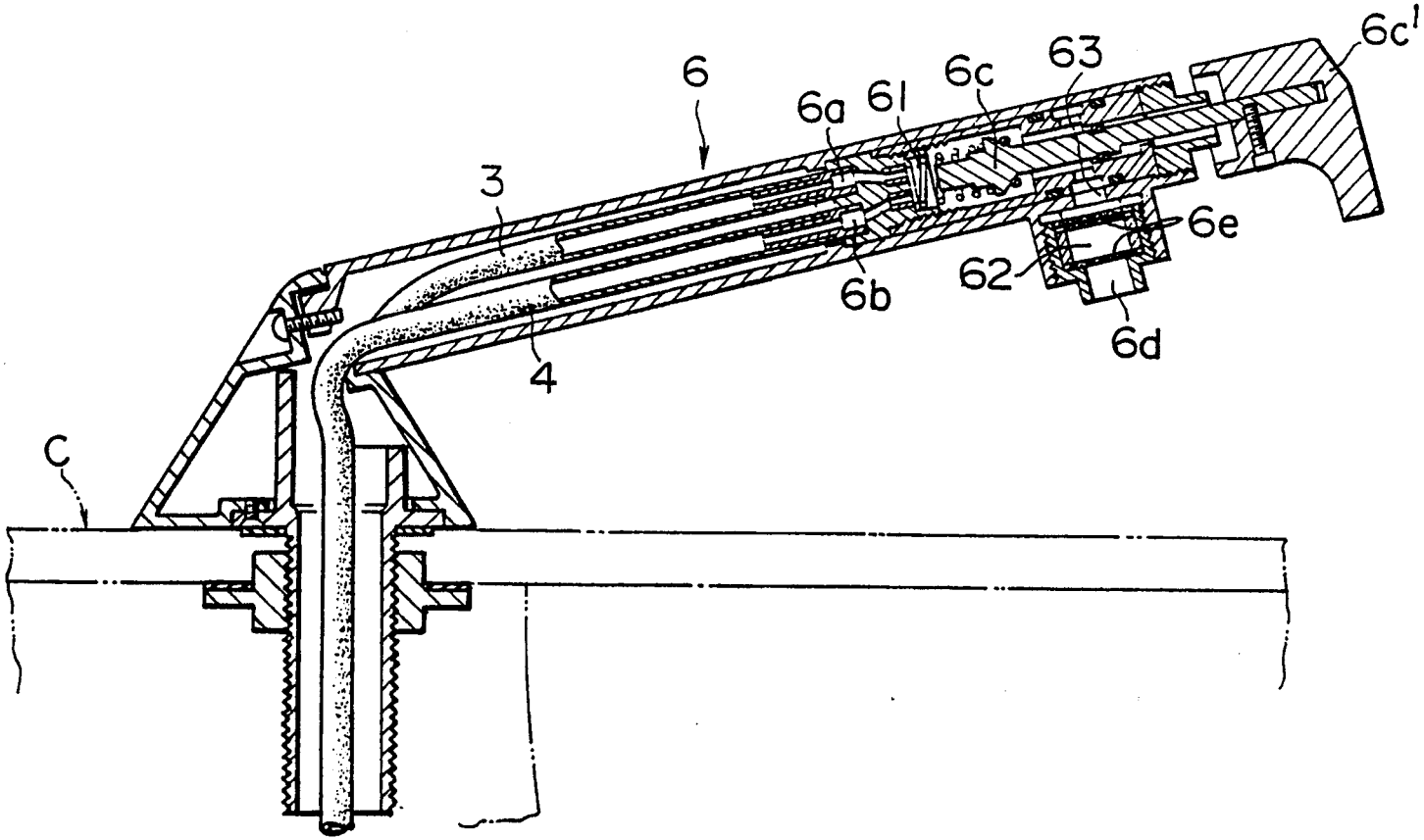
FIG. 6 is an enlarged sectional view for showing a discharging nozzle.
Figure 7:
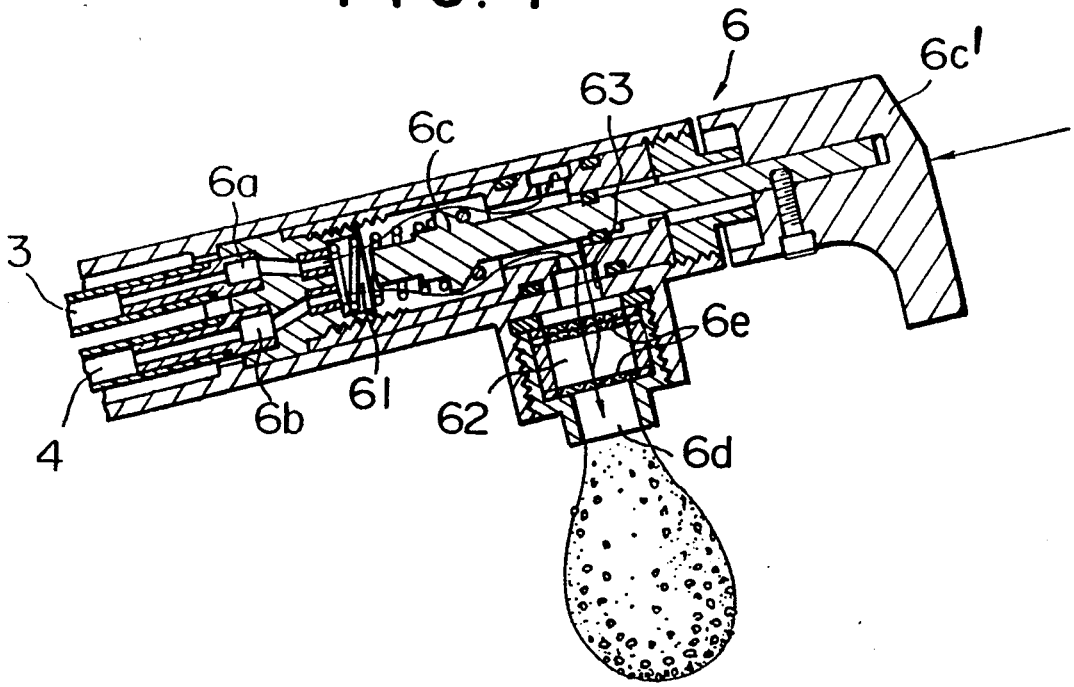
FIG. 7 is a sectional view for showing a substantial part of FIG. 6 to indicate a liquid soap discharging state.

The discharging nozzle 6 is mounted at a hand washing basin, a face washing basin, a hair washing basin in their circumferential portions or other desired mounting surfaces C, and has, as shown in FIGS. 6 and 7, a liquid soap feeding port 6*a* and an air feeding port 6*b* therein. The liquid soap feeding pipe 3 is connected to the former and the air feeding pipe 4 is connected to the latter. An inside part of the discharging nozzle is provided with a mixing chamber 61 communicating with the feeding ports 6*a* and 6*b* and an agitating chamber 62 communicating with the discharging port 6*d*. The mixing chamber 61 and the agitating chamber 62 communicate with each other through a passage 63 having a small diameter.

The discharging nozzle 6 is provided with an opening or closing valve 6*c*, and the agitating chamber 62 has several strainers 6*e* (3 pieces in the preferred embodiments) mounted therein.

The opening or closing valve 6*c* may be of an electrical or an electromagnetic unit opened for a specified period of time with an electrical signal based on a sensing of a hand through a human sensor such as a photoelectrical sensor, or the like, or a pressing operation of a touch switch, or may be of a manual unit opened while a push button is being depressed under a mechanical operation of pushing the push button, or for a specified period of time. However, as indicated in the drawing, the manual opening or closing valve 6*c* is operated under an operation of the push button 6*c*'.

The liquid soap supplying device A1, constructed as above described, is operated such than an operation of the compressor 21 is controlled by the control part 5 in such a way that a pressure within the tank 1 is kept at a specified range (0.3 $kgf/cm^2$ to 0.5 $kgf/cm^2$) and both liquid soap and air are supplied to each of the discharging nozzles 6. As the push button 6*c*' is depressed by each of the discharging nozzles 6, the supplied liquid soap and the air are mixed with each other within the mixing chamber 61 and they are agitated by strainers 6*e*. Then, the liquid soap is discharged in its bubbled form.

In this way, discharging of bubbled liquid soap may prevent not only some disadvantages that an excessively strong discharging state of liquid soap under a pressurizing force of the compressor 21 causes the liquid soap to be struck against the hand and splashed or flowing down the hand, but also enables an efficient usage of a small amount of liquid soap as well as saving the liquid soap.

The aforesaid device A1 is operated such that the air in the tank 1 is always pressurized or compressed by the pressurizing device 2 to a predetermined pressure to cause both the liquid soap 110 and the air in the tank 1 to be forcibly fed to the discharging nozzle 6 under a pressure of the air, so that even if a plurality of supplying systems, i.e., nozzle systems, are arranged, it is not necessary to provide each of the compressor or supplying pumps for each of the systems, liquid soap and air. Thus, the device is simple in its structure, resulting in a concentrated supplying system for supplying bubbled liquid soap from one supplying source to a plurality of basins and hand washing units can be attained at a low cost.

In addition, air to be mixed with liquid soap is always kept in the tank 1, so that the bubbled liquid soap can be positively discharged.

Some details of the liquid soap supplying device A1 comprised of the aforesaid basic configuration of the present device will be described.

The nearest location of the aforesaid liquid soap feeding pipe 3 for the tank 1 (the most upstream side of the liquid soap feeding pipe 3) is provided with a check valve 30, and with this check valve, even if the remaining liquid soap in the tank 1 is eliminated, the liquid soap is fully filled in the liquid soap feeding pipe 3. Thus, the air in the tank 1 does not enter the liquid soap feeding pipe 3 and does not cause the remaining liquid soap in the feeding pipe 3 to be solidified, resulting in that it does not produce any disadvantages that the liquid soap feeding pipe 3 is clogged.

In addition, in place of the aforesaid check valve 30, the locations near each of the discharging nozzles 6 (the most downstream of the liquid soap feeding pipe 3 and the air feeding pipe 4) branched from the liquid soap feeding pipe 3 and the air feeding pipe 4 may be provided with check valves 40. Such an arrangement as described above can prevent some disadvantages that air enters from the discharging nozzles 6 into the liquid soap feeding pipe 3 or liquid soap enters the air feeding pipe 4 to cause the liquid soap to be fixed in each of the pipes 3 and 4 and clog the same. Concurrently with this operation, the present invention prevents the liquid soap in the liquid soap feeding pipe 3 from being pushed back by air and can provide stability in the discharging operation at the beginning of discharging liquid soap. In the drawings, both check valves 30 and 40 are shown to be installed and any one of them will be placed in a practical system.

Figure 8:
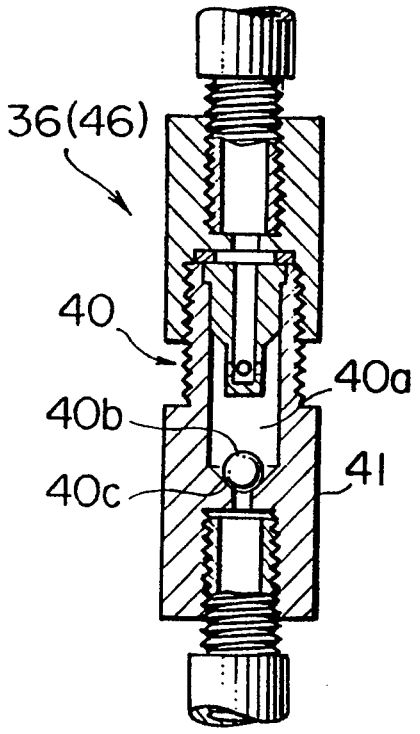
FIG. 8 is an enlarged sectional view for showing a check valve.
Figure 9:
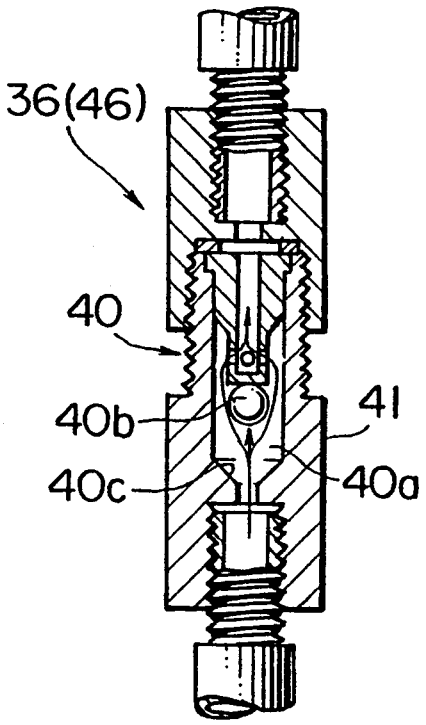
FIG. 9 is a view for showing an operating state in FIG. 8.

The aforesaid check valves 40 are arranged in rising parts 3*b* and 4*b* in the liquid soap feeding pipe 3 and the air feeding pipe 4, respectively, and as shown in FIGS. 8 and 9, there are provided a spherical valve member 40*b* within a valve chamber 40*a* arranged in a coupling pipe 41 and a funnel-like valve seat 40*c* on which the valve member 40*b* is seated, and the valve is closed by the weight of the valve member 40*b*, resulting in that, as compared with a system in which the valve is closed by a forced biasing means such as a spring or the like, even if the inside part of the tank 1 shows a low pressure, a pushing-up of the valve member 40*b* is not prohibited and a reliability of the check valve 40 can be improved. However, in this case, it is necessary for the rising-up parts 3*b*, 4*b* to be kept in their vertical states.

The air feeding pipe 4 is provided with either a manual or an electrical flow rate adjusting valve 50 at its appropriate midway location, this adjusting valve 50 being manually or electrically operated so as to adjust an air supplying amount for the discharging nozzles 6, thereby a fine texture or hardness of bubbled discharged liquid soap can be optionally adjusted in compliance with a preference of the user. In addition, a complete closing of the air feeding pipe 4 stops an air supply to the discharging nozzles 6 to enable the non-bubbled water-flow, such as liquid soap to be discharged from the discharging nozzles 6.

Figure 4:
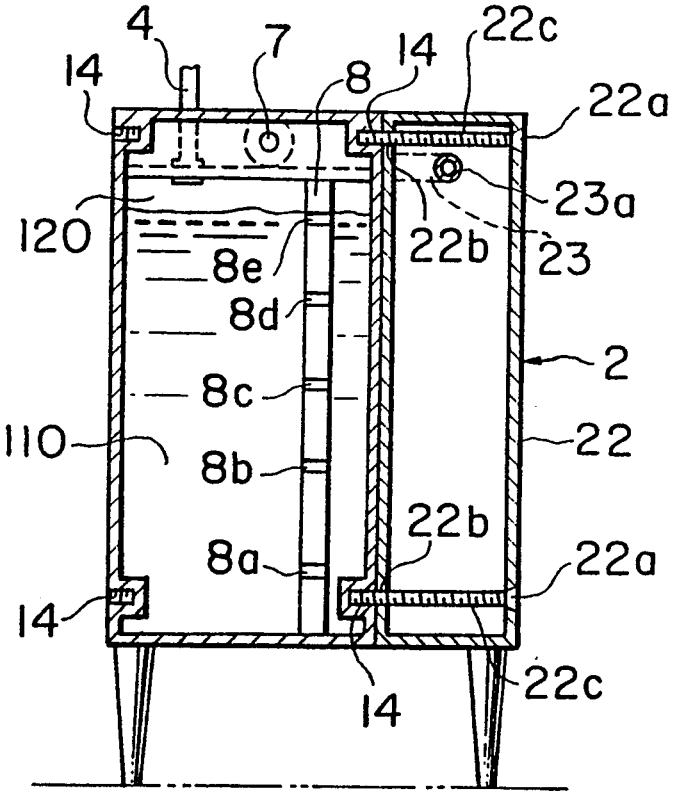
FIG. 4 is a longitudinal front elevational view in section for showing a tank.
Figure 5:
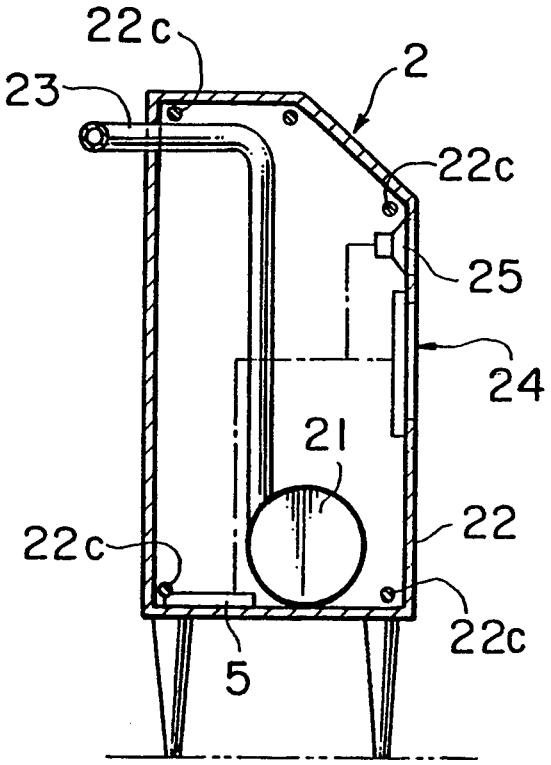
FIG. 5 is a longitudinal side elevational view in section for showing a casing.

As shown in FIG. 4, the casing 22 is formed to be fixed to any one of the right and left side surfaces of the tank 1 in such a way as it may be conveniently placed in response to a setting position of the tank 1.

That is, the right and left side surfaces of the tank 1 are provided with a plurality of threaded holes 14 at several positions and further, the right and left side surfaces of the casing 22 are provided with a plurality of holes 22*a* and 22*b* in such a way as they may oppositely face against each of the threaded holes 14. In this way, extreme ends of long bolts 22*c* inserted from holes 22*a* at one side surface are threadably fitted into the threaded holes 14 through holes 22*b* at the other side surface and the casing 22 is removably fixed to the side surface of the casing 22.

Figure 2:
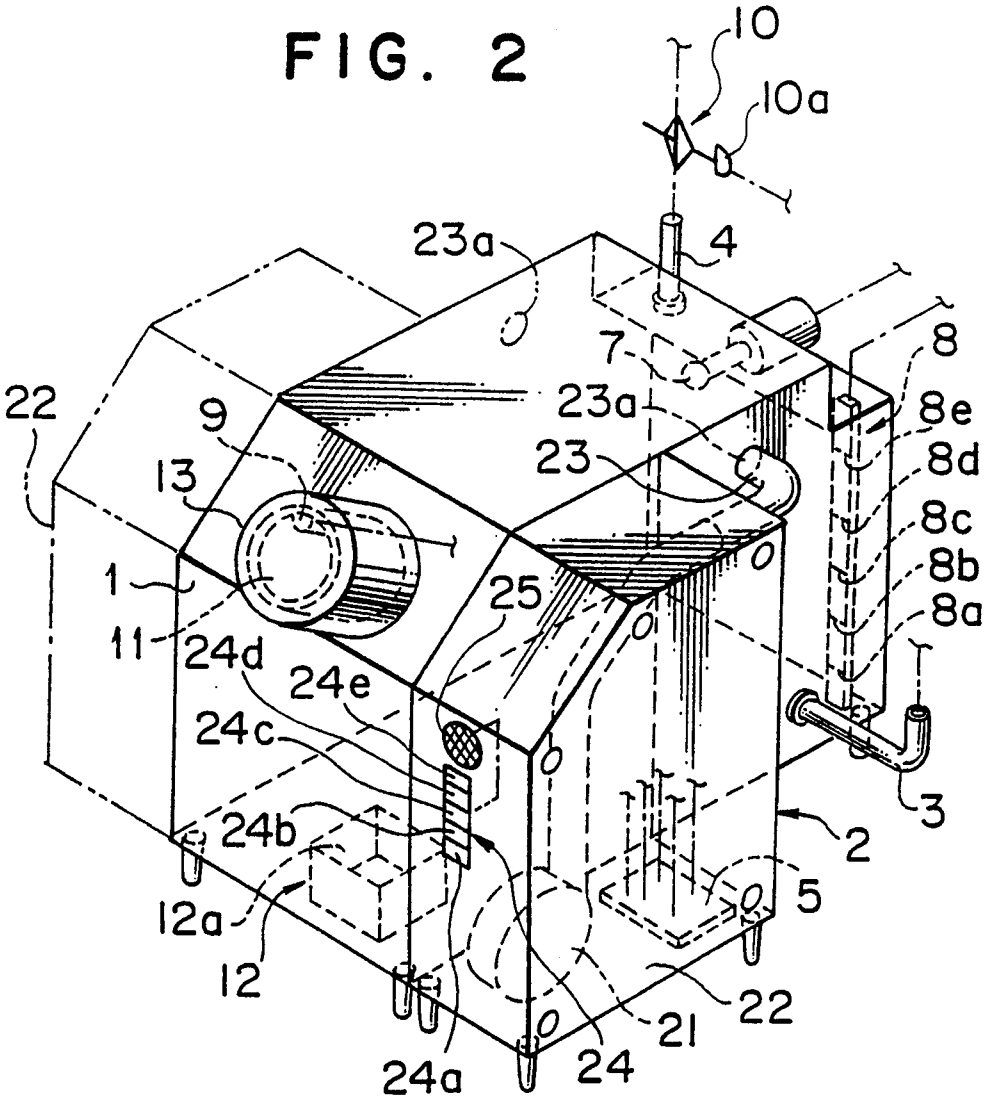
FIG. 2 is a perspective view for showing a tank and a casing.

In the drawings, one example in which the casing 22 is fixed to the right side of the tank 1 is illustrated and it is optional that the casing 22 may be fixed to the left side of the tank 1 as indicated by a phantom line in FIG. 2. It is also apparent that both right and left sides surfaces of the tank 1 are inscribed with lines for opening a connection port for the air intake pipe 23, i.e., the air intake port 23*a* and only one of the lines is opened in response to a right or a left location of the casing 22.

Figure 10:
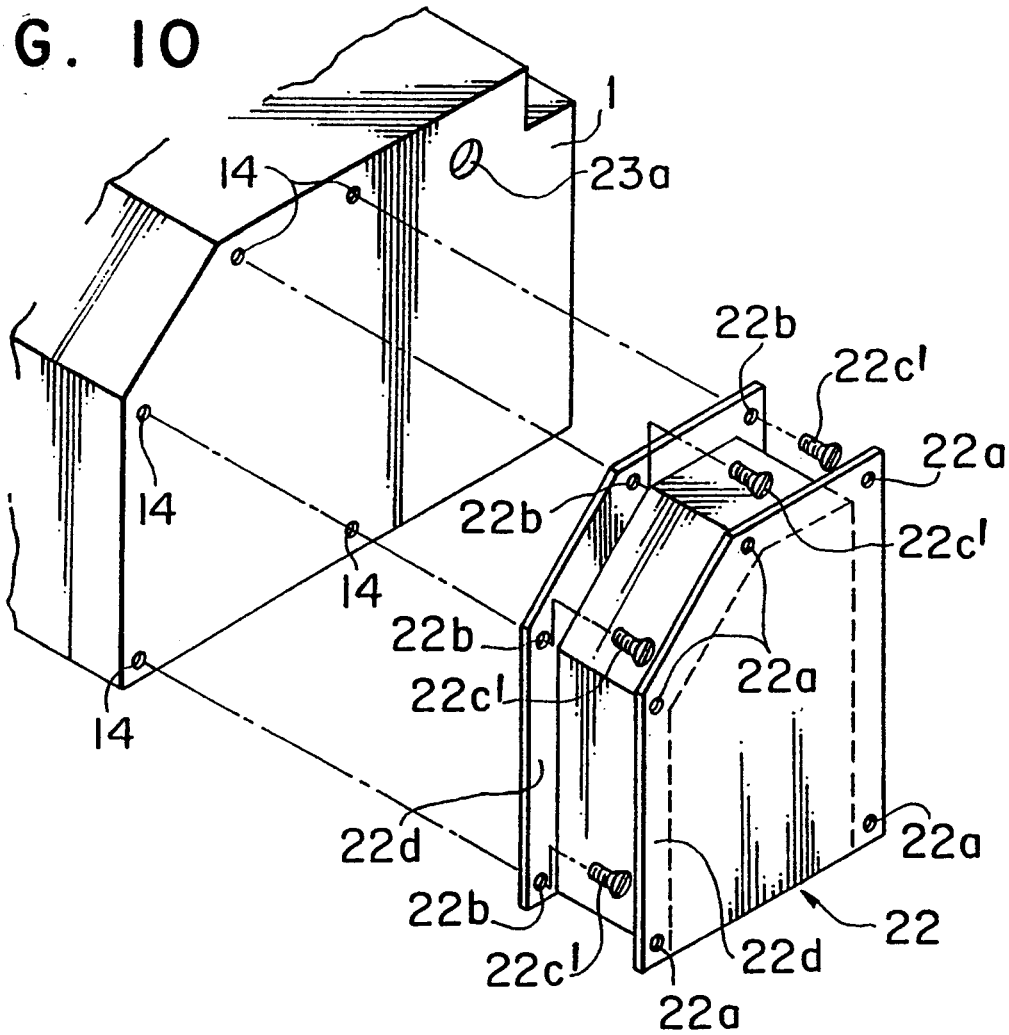
FIG. 10 is an exploded perspective view for showing a tank and a casing.

As shown in FIG. 10, it is also possible to arrange the casing 22 such that fixing pieces 22*d* are extended at the right and left edge portions and then the holes 22*a* and 22*b* are opened at the fixing pieces 22*d*. In this case, in place of the long bolts 22*c*, short bolts 22*c*' are applied to fix the casing to the tank 1.

A bottom wall of the tank 1 is provided with a draining port 12 for use in discharging deposits.

Figure 11:
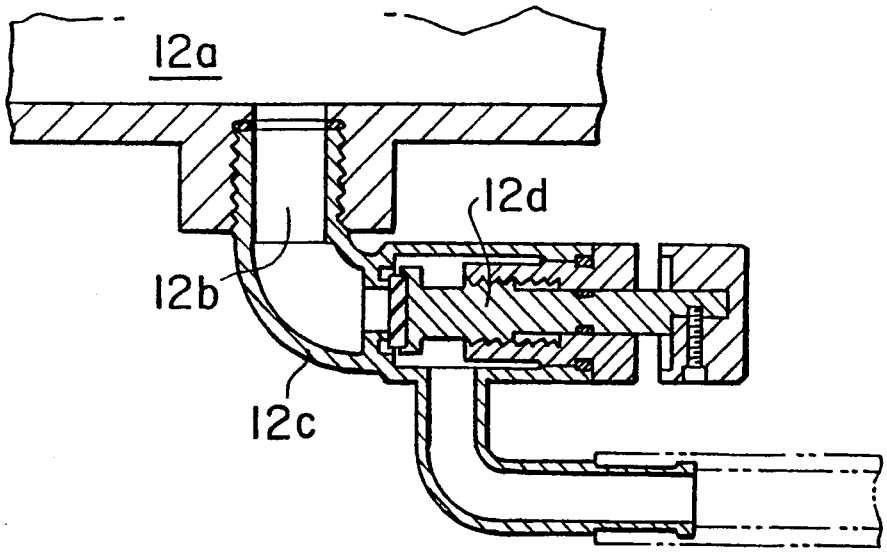
FIG. 11 is an enlarged sectional view for showing a drain port.

As shown in FIG. 11, the draining port 12 has a concave portion 12*a* having a proper size, a bottom part of the concave portion 12*a* is provided with a discharging port 12*b*, a drain pipe 12*c* is drawn from the discharging port 12*b* and the draining pipe 12*c* is provided with an opening or closing valve 12*d*.

Accordingly, the deposit in the tank 1 is accumulated in the concave part 12*a*, and then the deposit passes through a drain pipe 12*c* and is discharged out of the tank 1 by opening the opening or closing valve 12*d*. Thus, it is not necessary to require a troublesome operation for setting the tank 1 upside-down and discharging the deposit and it is possible to facilitate cleaning of the tank 1.

An additional controlling function will now be described.

A remaining volume sensor 8 for the liquid soap 110 is arranged in the tank 1, an opening or closing sensor 9 is arranged in the supplementary port 11 and also an air drain port 10 having a safety valve 10*a* is arranged in the midway part of the air feeding pipe 4. A front surface of the casing 22 is provided with a remaining volume displaying part 24 and a buzzer 25. Each of the remaining volume sensor 8, opening or closing sensor 9, safety valve 10*a*, remaining volume displaying part 24 and buzzer 25 is electrically connected to the control part 5 and all the operations of these devices are controlled by the control part 5.

Figure 12:
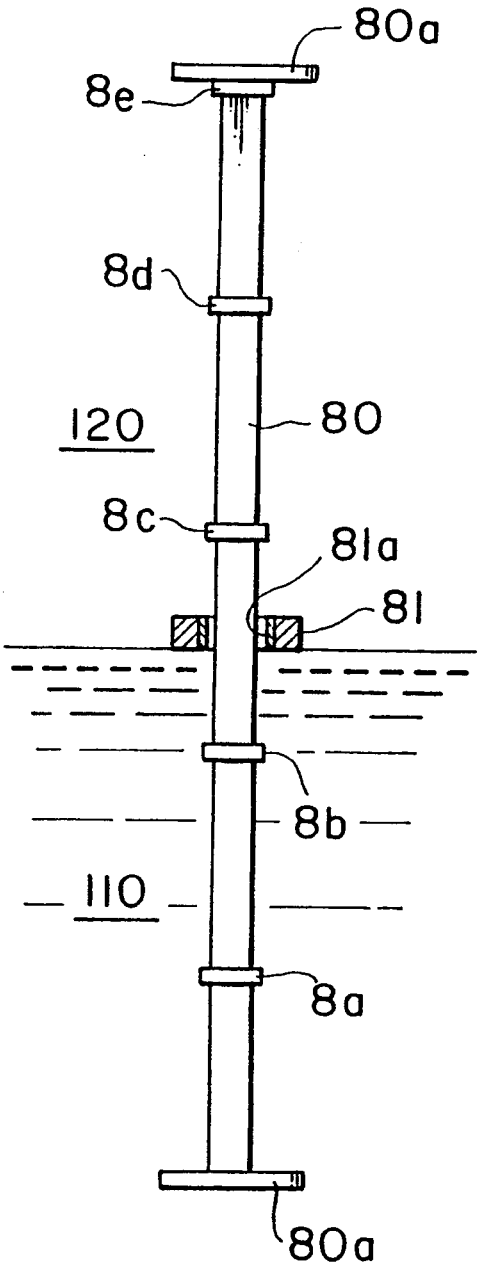
FIG. 12 is a front elevational view partly broken away to show a remaining amount sensor.

The remaining volume sensor 8 is, as shown in FIG. 12, made such that an annular float magnet 81 is inserted onto a guide shaft 80 which is upright within the tank 1 in such a way that the magnet 81 may be moved up and down freely. An outer periphery of the guide shaft 80 is provided with contact points (magnetic sensing elements) 8*a* to 8*e* in five steps and the remaining volume sensor 8 is constructed by a multi-staged float switch provided with a contact element 81*a* which contacts or moves away from each of the contact points 8*a* to 8*e* at an inner periphery of the float magnet 81. The remaining volume of liquid soap is detected in a step-wise manner through a contact between the contact element 81*a* of the float magnet 81 and each of the contact points 8*a* to 8*e* of the guide shaft 80, the detected volume is transmitted as an electrical signal to the control part 5 and then the remaining volume of liquid soap within the tank 1 is acknowledged in a step-wise manner.

The lower-most stage contact point 8*a* in the remaining volume sensor 8 is placed at a location higher than a liquid soap discharging port 3*a* in the tank 1 and the uppermost stage contact point 8*e* is arranged at a location lower than the supplementary port 11. Reference numerals 80*a* in the figure denote stoppers arranged at an upper end and a lower end of the guide shaft 80.

Figure 13:
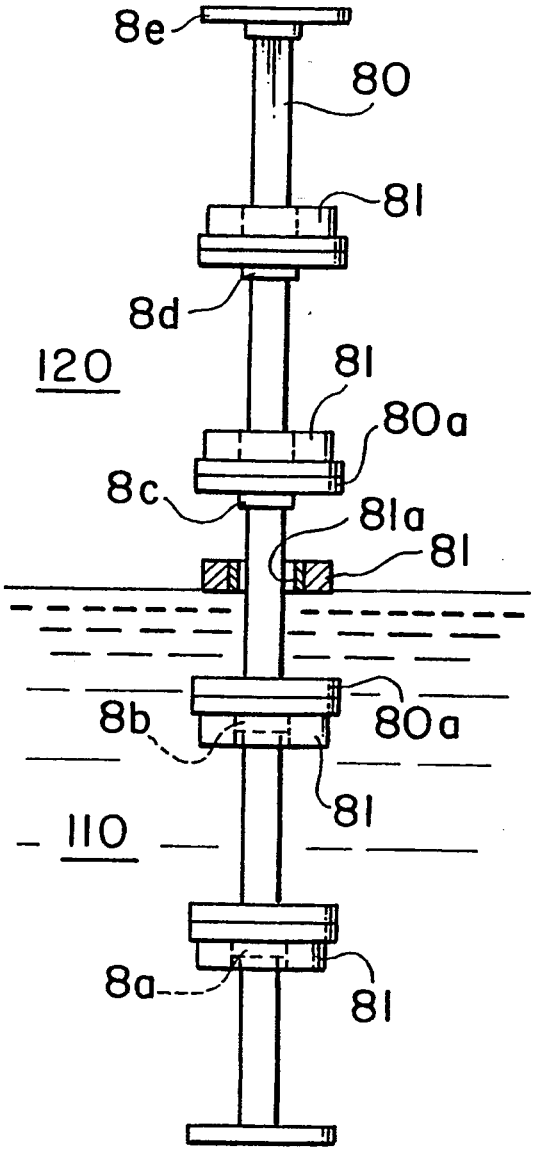
FIG. 13 is a front elevational view partly broken away to show another example of a remaining amount sensor.

As shown in FIG. 13, the aforesaid remaining volume sensor 8 has contact points 8*a* to 8*e* in multi-stage manner at an outer periphery of the guide shaft 80 and it is also possible to arrange the upper and lower stoppers 80*a* for every contact point 8*a* to 8*e* and also to have the float magnets 81 at every contact point.

The opening or closing sensor 9 is comprised of a micro-switch arranged in the supplementary port 11. The opening or closing sensor 9 may transmit each of a closed state and an opened state of the supplementary port 11 with a lid 13 as an electrical signal to the control part 5 so as to cause the control part 5 to acknowledge an opened or closed state (opened or closed state of the lid 13) of the supplementary port 11.

A safety valve 10*a* of the air drain port 10 is comprised of an electrical (electromagnetic) three-way valve to open the air feeding pipe 4 under a normal state and to close the air drain port 10. In this way, the safety valve 100 is controlled by the control part 5 in such a way as it may be operated when the opening or closing sensor 9 detects an opening of the supplementary port 11 (a lid 13 is opened), or when the remaining volume sensor 8 detects the lower-most position (8*a*) of the liquid soap remaining volume, or when the pressure sensor 7 detects a value more than a high set value $P_3$ (0.7 kgf/cm$^2$ in the preferred embodiment), opens the air drain port 10, removes the compressed air in the tank 1 and at the same time operates after a specified period of time (for example, 60 seconds) elapses and closes the air drain port 10. The air drain port 10 can be arranged at the tank 1 separately and independently from the air feeding pipe 4, and in this case the safety valve 10*a* is constructed by an electrical (electromagnetic) opening or closing valve for use in opening or closing the air drain port 10.

The safety valve 10*a* is controlled by the control part 5 in order to prevent a poor opening or closing in such a way as it may be opened or closed only for a slight period of time (for example, 0.1 seconds) every time the compressor 21 is started to operate.

The remaining volume displaying part 24 is constructed such that light emitting diode elements 24*a* to 24*e* are arranged in a multi-stage manner in correspondence with each of the contact points 8*a* to 8*e* in the remaining volume sensor 8 and at the same time each of the elements 24*a* to 24*e* is electrically connected. In this way, the device is controlled by the control part 5 in such a way that each of the elements 24*a* to 24*e* is lit through sensing of the remaining volume with the corresponding contact points 8*a* to 8*e*, which are lit for a specified period of time (for example, 5 seconds) with a sensing signal from the upper-most contact point 8e at the upper-most stage element 24e, and an over-flow during supplementing of the liquid soap is indicated and after this operation, it is lit.

The buzzer 25 is controlled by the control part 5 in such a manner that it may ring for a specified period of time (for example, 5 seconds) when the remaining volume sensor 8 detects the uppermost level (8e) of the remaining volume of liquid soap and an overflow at the time of supplementing the liquid soap is indicated.

In addition to the aforesaid pressurizing control means, the control part 5 is provided with (I) a control means for acknowledging a remaining amount of the liquid soap 110 in the tank 1 in a step-wise manner and operating the remaining volume displaying part 24 as described above, (II) a control means for preventing opening of the lid 13 and preventing a clogging of the liquid soap 110 in the tank 1 descends down to its lowermost location, (III) a control means for stopping an operation of the compressor 21 upon acknowledgement of an opened state of the lid 13 (an opened state of the supplementing port 11), (IV) a control means for indicating an overflow state for operating the remaining volume displaying part 24 and the buzzer 25 upon acknowledgement of an increase of the remaining volume of the liquid soap 110 in the tank 1 up to the uppermost position, (V) a control means for protecting the tank so as to operate the safety valve 10a upon acknowledgement of a pressure within the tank 1 more than a higher set pressure $P_3$ (0.7 kgf/cm$^2$), (VI) a control means for preventing a fixing of the safety valve so as to operate the safety valve as described above every time the operation of the compressor 21 is started or the like.

With the foregoing configuration, the compressor 21 is operated such that a pressure within the tank 1 may be kept within a specified range while the supplementary port 11 is closed and then bubble-like liquid soap can be discharged from each of the discharging nozzles 6.

In addition, a remaining volume of the liquid soap 110 in the tank 1 is displayed in the remaining volume displaying part 24 in a step-wise manner and a supplementing of the liquid soap can be efficiently carried out.

As the remaining volume of the liquid soap in the tank 1 reaches the lower-most level (8a) of the remaining volume sensor 8 or the lid 13 is opened when the liquid soap is supplemented, the compressor 21 is stopped, and at the same time, the air drain port 10 is opened to remove the air in the tank 1. With such an arrangement, the present invention eliminates a probability of opening of the lid 13 due to an inner pressure in the tank 1, to perform a safe supplementation of the liquid soap and to prevent a useless operation of the compressor 21 when the lid 13 is released.

In addition to the aforesaid effects, the arrangement in which the liquid soap taking-out port 3a is arranged at a location lower than the lowermost location (8a) of the remaining volume sensor 8 may prevent the remaining volume of the liquid soap 110 from being placed lower than the liquid soap discharging port 3a. With such an arrangement, it is possible to prevent the air in the tank 1 from entering the liquid soap feeding pipe 3 and further prevent some disadvantages of solidifying of the remaining liquid soap in the pipe and clogging the liquid soap feeding pipe 3.

As the remaining volume of the liquid soap 110 within the tank 1 is increased up to a place near the supplementing port 11 when the liquid soap is supplemented, the buzzer 25 is rung, the upper-most element 24e in the remaining volume displaying part 24 is illuminated to indicate an over-flow condition of the liquid soap and then a useless consumption of the liquid soap can be prevented.

In addition, as the inner pressure in the tank 1 exceeds a high set pressure $P_3$ (0.7 kgf/cm$^2$), the safety valve 10a is operated to reduce a pressure within the tank 1 and to protect that tank 1.

The safety valve 10a is opened or closed every time the compressor 21 is operated to cause the liquid soap adhered to the safety valve 10a to be solidified and further to prevent a possibility of not operating the safety valve 10a and then a reliability in controlling operation described above or to be described later is improved.

In addition, the aforesaid control part 5 is provided with an emergency stopping means for stopping an operation of the compressor 21 when an abnormal state indicated in the following paragraphs (1) or (2) is detected, opening the air drain port 10 for a specified period of time under an operation of the safety valve 10a, illuminating each or all elements 24a to 24e at the remaining volume displaying part 24 to indicate an occurrence of an abnormal state at the device A1, stopping the operation of the compressor 21 when an abnormal state indicated in paragraph (3) is detected and opening the air drain port 10 for a specified period of time, diminishing the light emitting diode elements 24a to 24e corresponding to the contact points 8a to 8e showing a detection of the remaining volume other than the liquid surface of the remaining liquid soap, illuminating other elements 24a to 24e and indicating an occurrence of an abnormal state.

(1) that the pressure within the tank 1 does not reach the high set pressure $P_1$ (0.5 kgf/cm$^2$) even after a specified period of time (for example, 5 minutes) elapses upon inputting an instruction for operating the compressor 21 from the control part 5;

(2) that the pressure within the tank 1 is more than $P_4$ (0.1 kgf/cm$^2$ in the preferred embodiment) even after a specified period of time (for example, 60 seconds) elapses from an inputting of an instruction for operating the safety valve 10a of the air drain port 10 from the control part 5; and (3) that the remaining volume of liquid soap 110 in the tank 1 is detected by the remaining volume sensor 8 over the liquid level.

In this case, when the abnormal states indicated in the above paragraphs (1) to (3) occur, the compressor 21 is stopped and an interior part of the tank 1 is reduced. Thus, it is possible to eliminate a certain dangerous condition in which the device A1 continues to operate when an air leakage occurs in the tank 1, the liquid soap feeding pipe 3, air feeding pipe 4 and discharging nozzle 5, or the like, or the control for the tank 1 may not be carried out, or an abnormal state is found in the remaining volume sensor 8, and further to improve safety and reliability of the device A1. Concurrently with this fact, it is also possible to inform a user of an occurrence of an abnormal state through an illumination of the remaining volume displaying part 24.

Figure 14A:
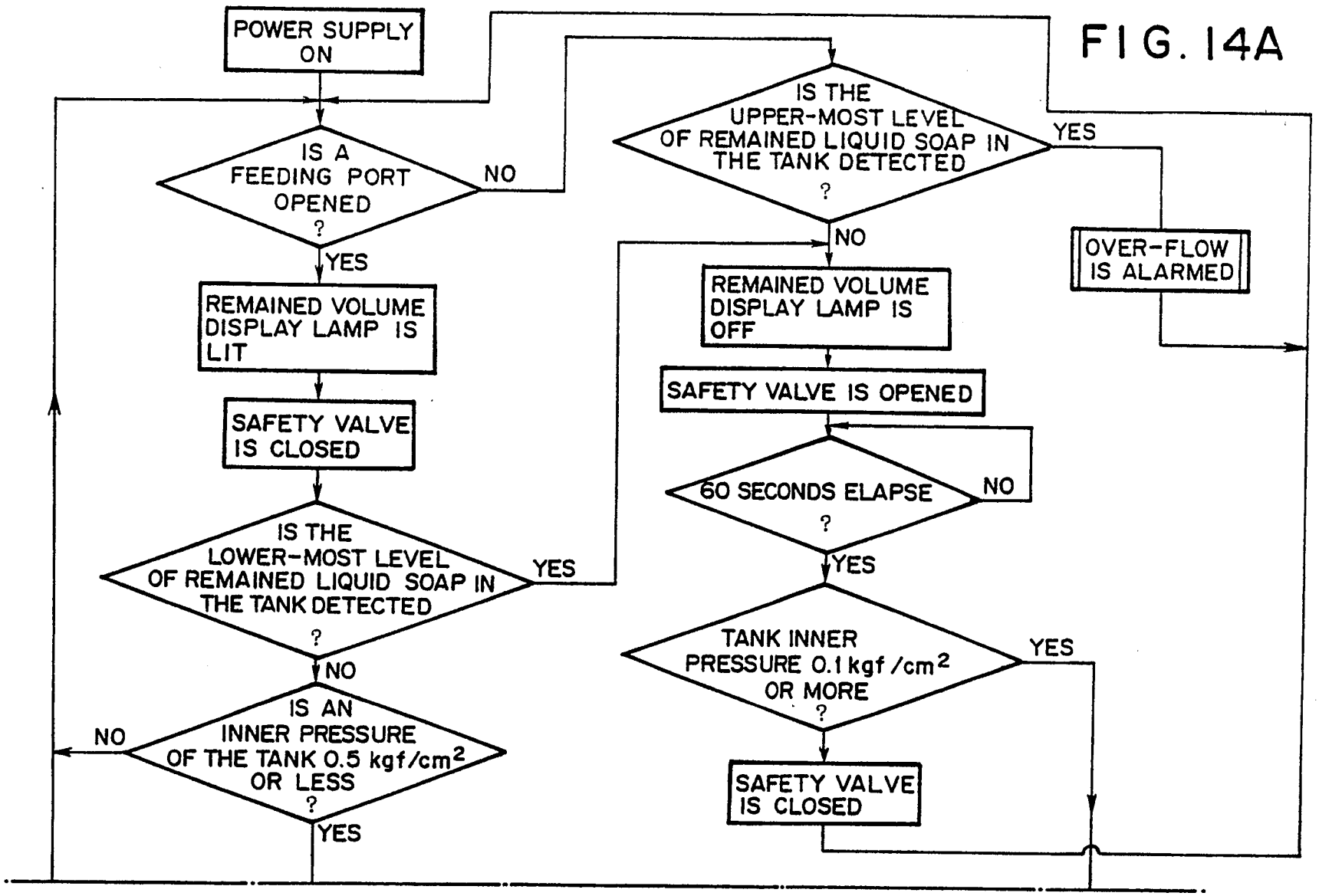
FIGS. 14, 14*a* and 14*b* illustrate a flow chart for controlling operation of the device shown in FIG. 1.
Figures 14, 14A, 14B:
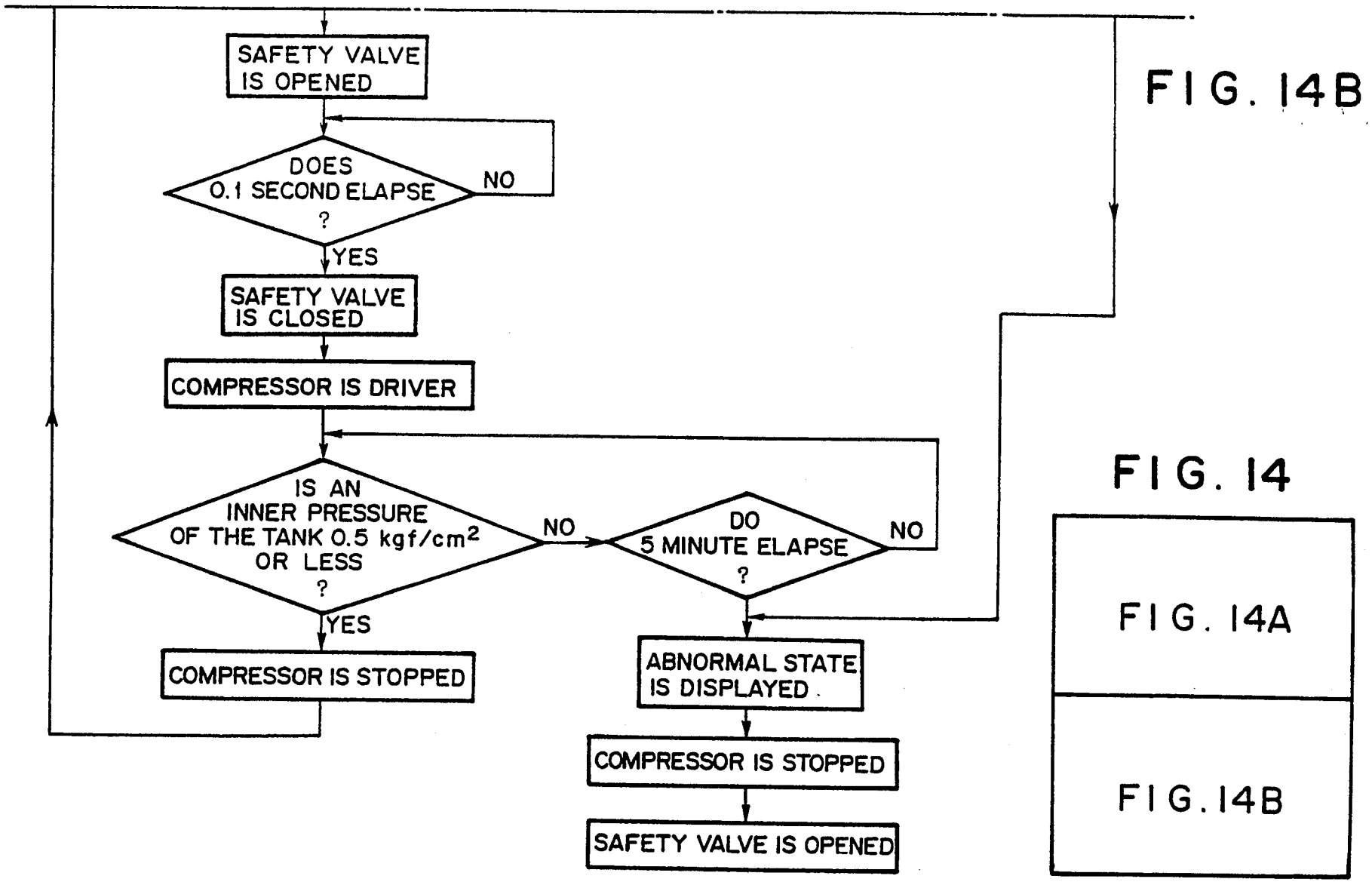

FIG. 14 illustrates a flow-chart concerning the control over the aforesaid liquid soap supplying device A1.

In addition, it may also be possible to provide a controlling function other than described above in the supplying device A1, for example, to arrange a temperature sensor near the compressor 21 in the casing 22, and when the temperature sensor detects a value more than the set temperature (an over-loaded condition of the compressor 21), a control means may be provided for stopping the compressor 21, or the like.

Liquid soap supplying devices A2 to A4 will be described in which each of the elements of the supplying device A1 will be described as follows.

Figure 15:
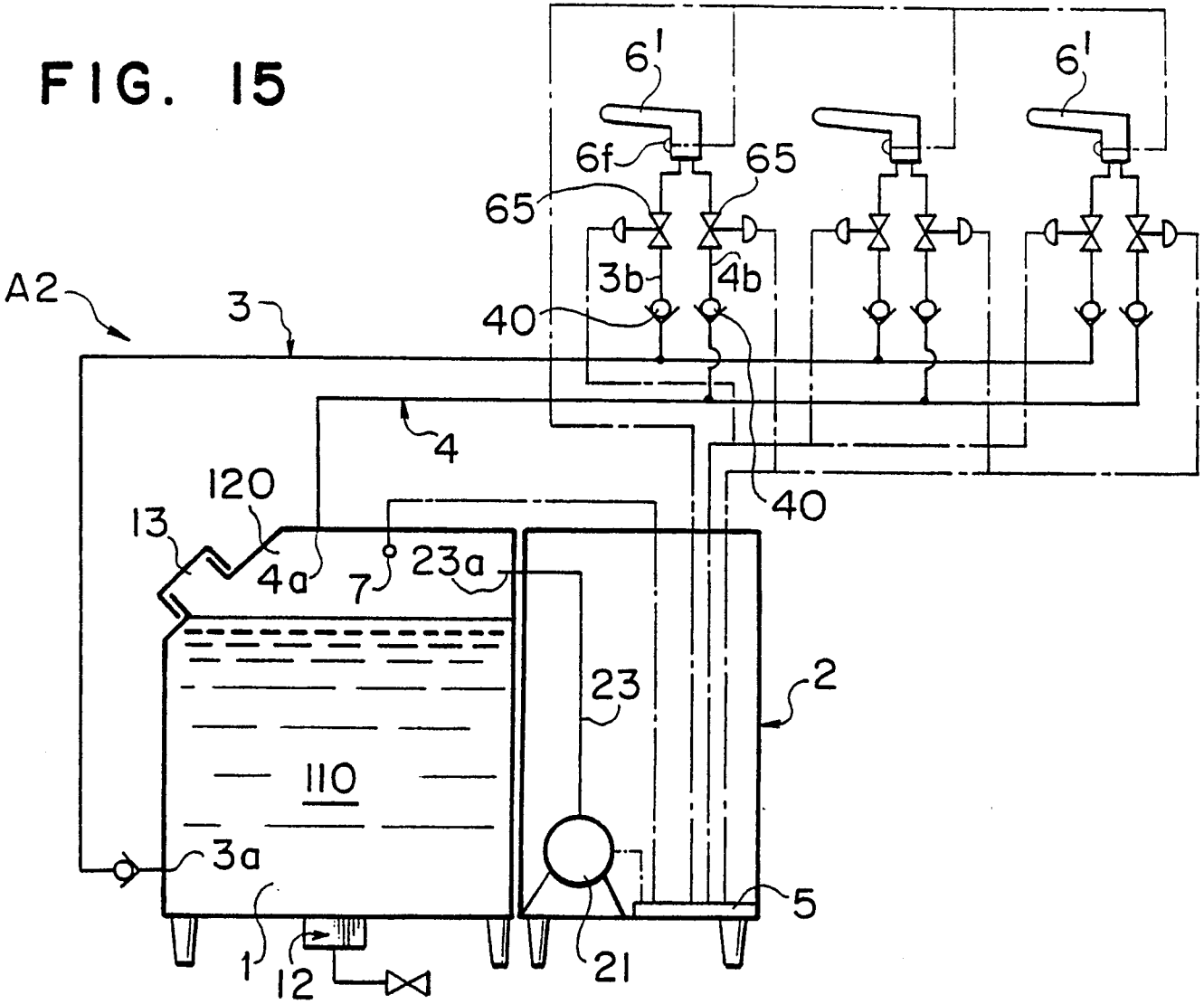
FIGS. 15, 20, 29, 30 and 32 are schematic views for showing other liquid soap supplying devices of the present invention.
Figure 16:
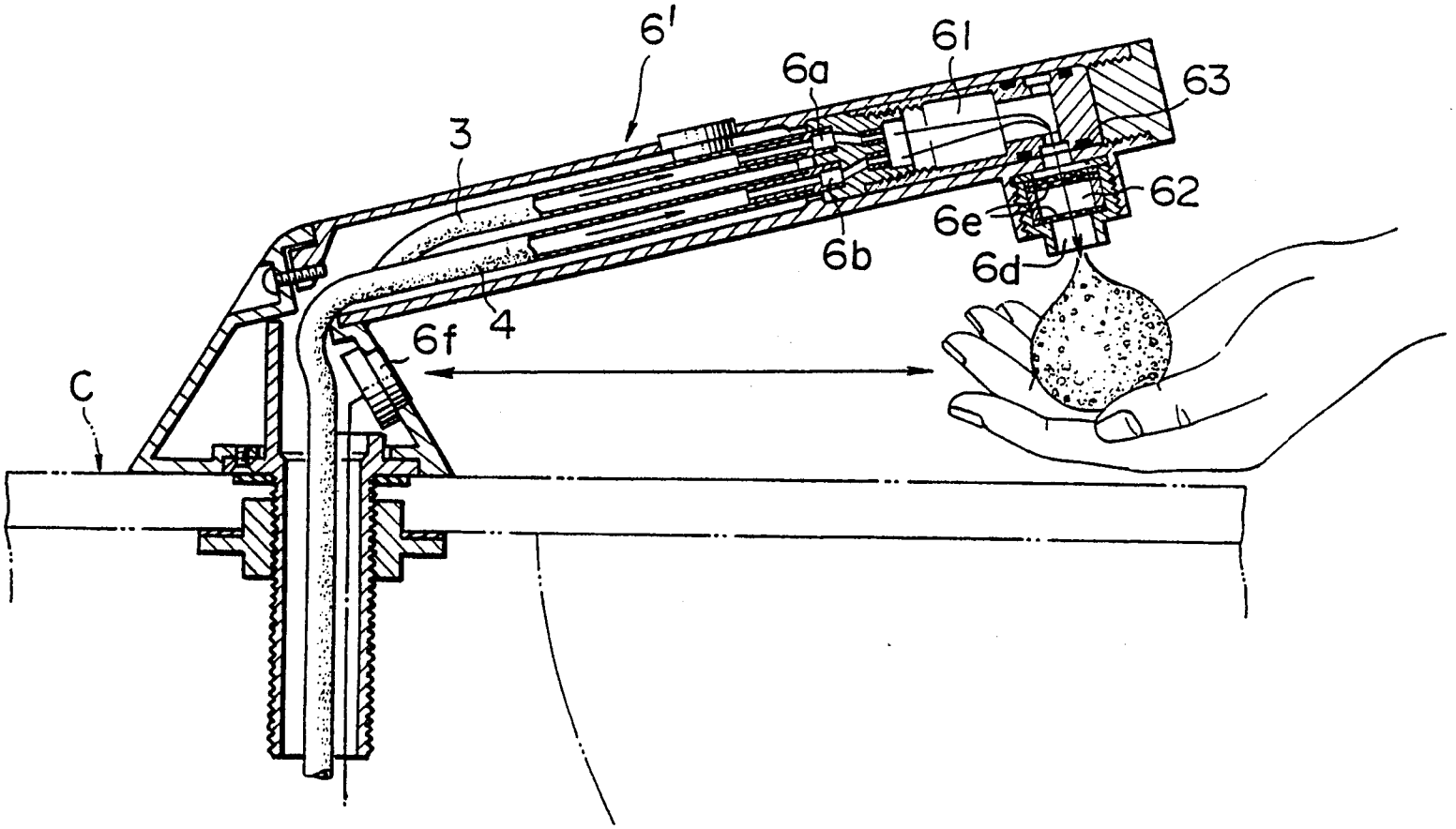
FIG. 16 is an enlarged sectional view for showing a discharging nozzle in FIG. 15.

In FIGS. 15 and 16, there is illustrated the liquid soap supplying device A2 having discharging nozzles 6' provided with electromagnetic or electrical opening or closing valves 65 opened for a specified period of time upon detecting a user in place of the above-described discharging nozzles 6.

The discharging nozzles 6' are provided with the liquid soap feeding port **6*a*, air feeding port 6*b*, air discharging port 6*d*, strainers 6*e*, mixing chamber 61, agitating chamber 62 and a flow passage 63, or the like, in the same manner as that of the above-described discharging nozzles 6, and further it has a photo-electrical sensor 6*f* at a predetermined location at the base end for sensing a hand extended just below the discharging port 6*d***.

The opening or closing valves 65 are arranged at downstream sides of the check valves 40 in the liquid soap feeding pipe 3 and the air feeding pipe 4 and further cooperatively connected to the control part 5 in such a manner that the valve may be opened or closed for a predetermined period of time through a sensing of the hand by the sensor **6*f***.

The sensor **6*f*** may sense automatically the hand or may be one of a sensor touch type.

According to the liquid soap supplying device A2, if the user is detected by the sensor **6*f*, the opening or closing valve 65 is opened for the predetermined period of time, the liquid soap of specified amount and the air are supplied to the discharging nozzles 6' and then only a specified amount of bubbled liquid soap is discharged from the discharging port 6*d***. Thus, it is possible to make a proper discharging amount of liquid soap in one time of use and to perform an efficient utilization of liquid soap.

In addition, in case of the supplying device A2, the control part 5 is provided with a control means for avoiding a judgment of an abnormal state in which the pressure within the tank 1 rapidly decreases when more than a plurality of discharging nozzles 6' are used concurrently.

The means are, for example, (1) when the two discharging nozzles 6' are used concurrently, the opening or closing valves 65 are controlled so as to be closed at 70% of a normal discharging time, (2) when the other discharging nozzle 6', the former discharging nozzle 6' is stopped in about one second and the latter discharging nozzle 6' is discharged after about one second under a control of the opening or closing valve 65, and (3) the opening or closing valve 65 is controlled in such a manner that when the other discharging nozzle 6' is used during a continuation of the discharging time of 70% at the previous discharging nozzle 6', the discharging nozzle 6' of the previous one is immediately closed to rapidly stop the discharging operation and the discharging of the latter discharging nozzle 6' for 70% discharging time of the normal time.

A limiting capability of the compressor 21 is set in such a manner that when five discharging nozzles 6' are used concurrently, no discharging is carried from the two discharging nozzles 6', or as one example, the opening or closing valves 65 of the two discharging nozzles 6' are not opened.

In addition, in the case that more than a plurality of discharging nozzles 6' are concurrently used, the opening or closing valves 65 may be controlled in such a manner that the opening or closing valves 65 in the air feeding pipe 4 are closed and the liquid soap is changed over to a discharging of water flow and then the air in the tank 1 may not be rapidly decreased.

With such an arrangement as described above, the pressure within the tank 1 is not rapidly decreased and a normal operation can be continued.

Figure 17:
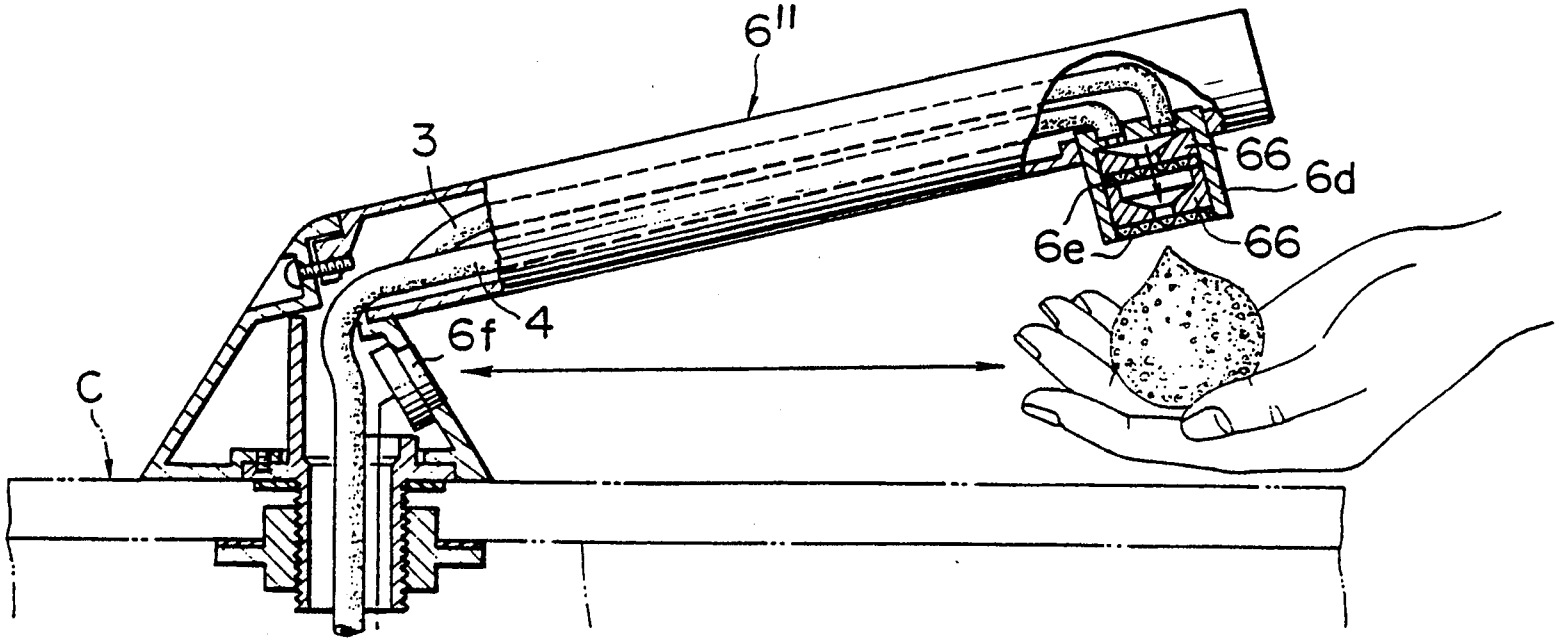
FIG. 17 is a front elevational view partly broken away for showing another example of a discharging nozzle.
Figure 18:
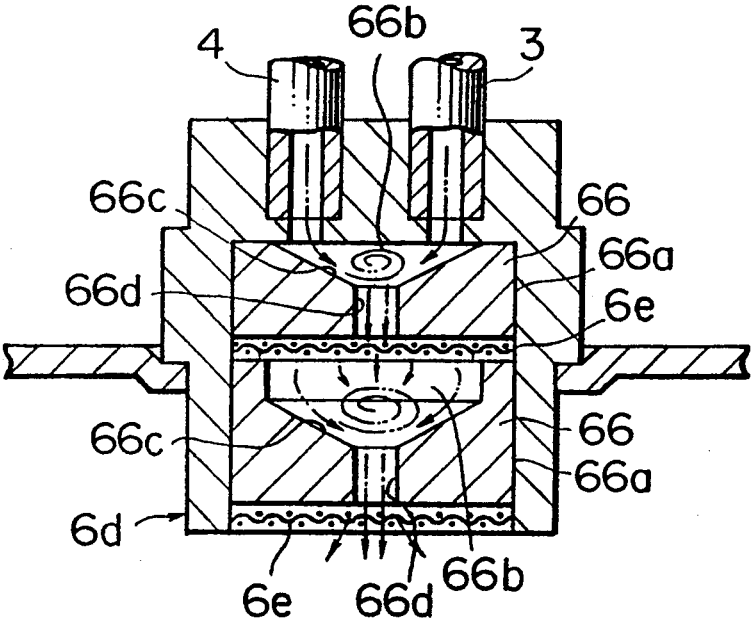
FIG. 18 is an enlarged view for showing a substantial part of a mixing chamber in a discharging nozzle in FIG. 17.
Figure 19:
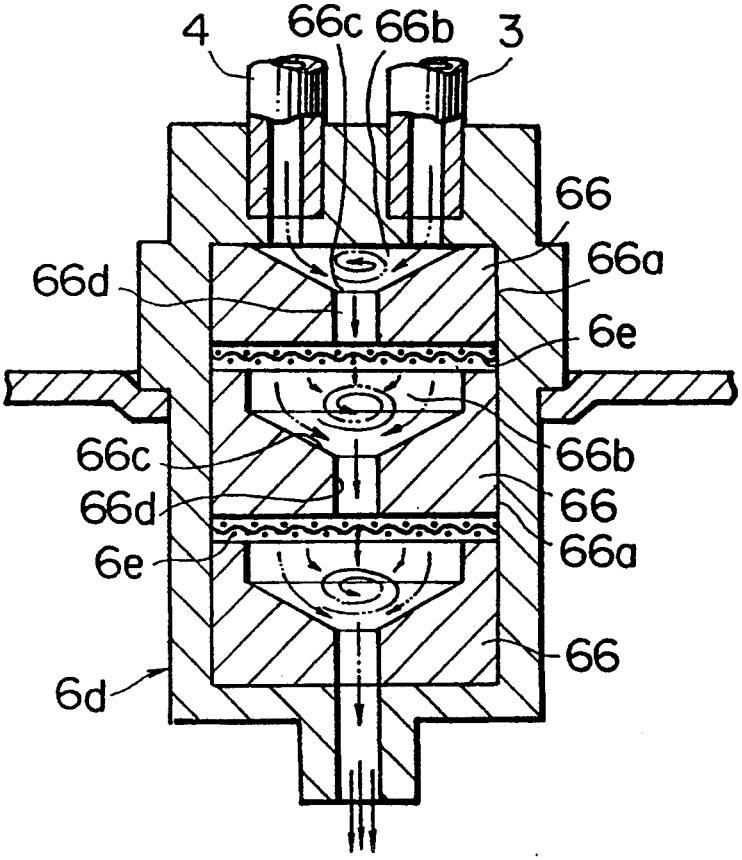
FIG. 19 is an enlarged sectional view for showing another example of a mixing chamber.

FIGS. 17 to 19 illustrate an example of a modification around the discharging port **6*d* in the above discharging nozzle 6'**.

As shown in FIG. 17, the discharging nozzle 6'' is made such that a discharging port **6*d* is vertically arranged at an extreme end lower surface of the main body having a hollow interior, in which the extreme end of the liquid soap feeding pipe 3 and the air feeding pipe 4 are connected to a primary side of the discharging port 6*d*, and at the same time the two strainers 6*e* are arranged in sequence in the discharging port 6*d* from the upstream side. A spacer 66 is arranged between each of the strainers 6*e* and 6*e*, and then a spacer 66 is arranged at the primary side of the strainer 6*e*** at the upstream side.

As shown in FIG. 18, the spacer 66 has a substantial funnel-like mixing chamber **66*b* by downwardly inclining a central part of the spacer main body 66*a*, and a communication passage 66*d* is formed over a lower surface of the spacer main body 66*a* from the deepest part 66*c* of the mixing chamber 66*b***.

As shown in FIG. 19, the spacer 66 may be further added to the secondary side of the downstream side strainer **6*e* in the discharging port 6*d*** and the number of strainers and spacers can be properly varied.

With such an arrangement as described above, upon sensing of a use of the device with the sensors **6*f*, the opening or closing valves 65 are opened for a specified period of time to feed the liquid soap and the air toward the discharging nozzle 6'', and further, the liquid soap and the air are forcibly blown from the extreme ends of the liquid soap feeding pipe 3 and the air feeding pipe 4 toward into the mixing chamber 66*b*. The liquid soap and the air are sufficiently and positively mixed within the substantial funnel-like mixing chamber 66*b*, pass through the communicating passage 66*d* arranged in the deepest part 66*c* of the mixing chamber 66*b*, and they are agitated by the strainer 6*e*, agitated by the downstream-side spacer 66 and the strainer 6*e* and then the liquid soap and the air are discharged from the extreme end of the discharging port 6*d*** in a fine bubbled state.

In the case that the discharging nozzle 6'' is used, a funnel-like mixing chamber **66*b* is arranged at the upstream side of each of the strainers 6*e* arranged in the discharging port 6*d*, the liquid soap and air are sufficiently and positively mixed within the mixing chamber 66*b*, thereafter they are agitated by the strainer 6*e***, so that even if several strainers are not arranged, fine bubbled liquid soap can be discharged.

In addition, since use of a smaller number of strainers **6*e* is satisfactory, it may eliminate defects of clogging the strainers 6*e*** with liquid soap under use over a long period of time.

A configuration of the part of the discharging port **6*d* shown in FIGS. 18 and 19 can be formed in the discharging port 6*d* of the discharging nozzle 6 shown in FIG. 6**.

In FIGS. 20 to 28, there is illustrated a liquid soap supplying device A3 provided with a tank 1', discharging nozzles 600, a remaining volume sensor 8' and a casing 220, or the like, as described below.

The tank 1' is comprised of a main body lower part 1*a* having an opened upper surface and a main body upper part 1*b* having an opened lower surface. Flanges 101 and 100 are arranged at each of the opening edges of the main body lower part 1*a* and the main body upper part 1*b*. These flanges 100 and 101 are connected by screws 102 to form a box-like shape in which the upper surface of the main body lower part 1*a* is covered by the main body upper part 1*b*.

Figure 23:
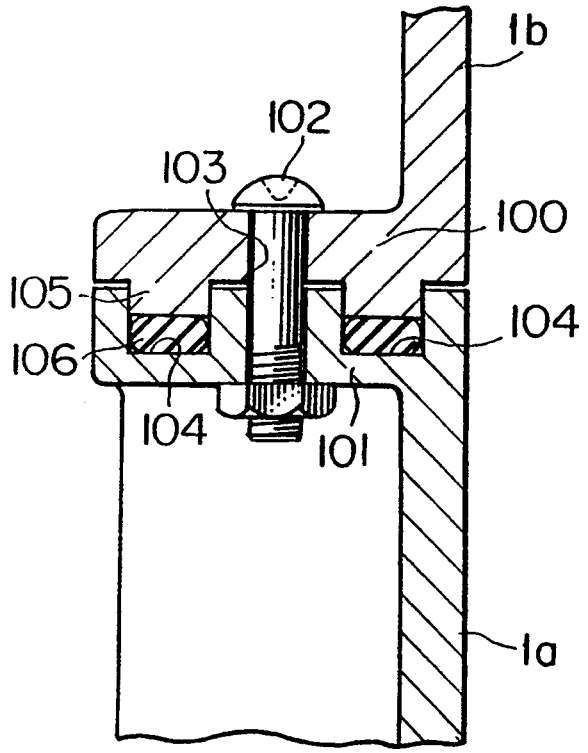
FIG. 23 is a sectional view taken along a line (23)—(23) of FIG. 22.
Figure 22:
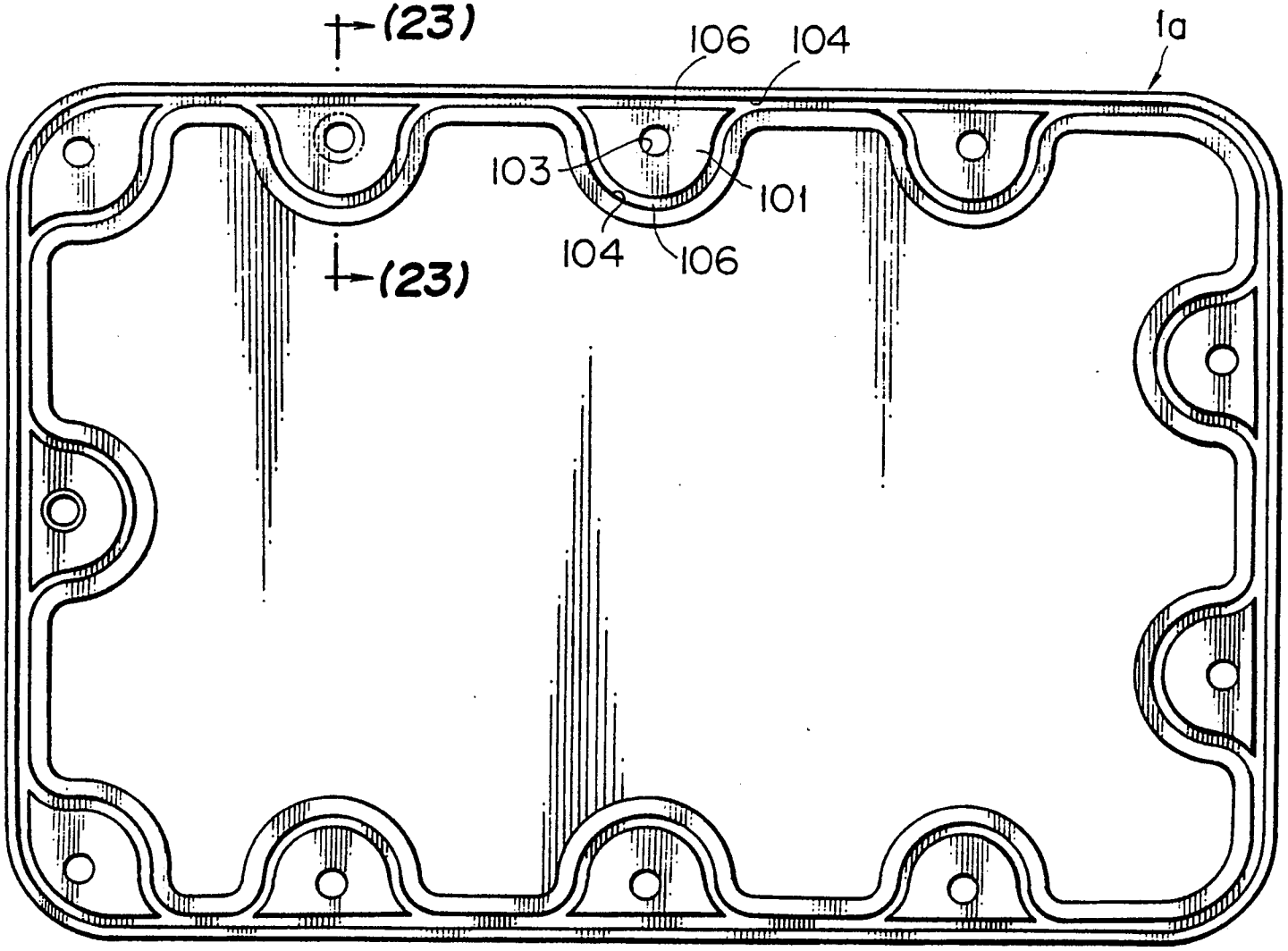
FIG. 22 is a top plan view for showing a lower part of a main body of a tank.

As shown in FIGS. 22 and 23, the flange 101 is provided with concave grooves 104 positioned inside and outside of the screw holes 103. The flange 100 is provided with projections 105 fitted to the concave grooves 104, and further packings 106 are present in the concave grooves 104. According to such a configuration as described above, it has effects that the fastening force applied by the screws 102 is concentrated in the concave grooves 104 of the projections 105 so as to shield an air flow passage and at the same time the packings 106, the concave grooves 104 and the projections 105 are forcibly made into an integral assembly so as to improve air-tightness.

Figure 20:
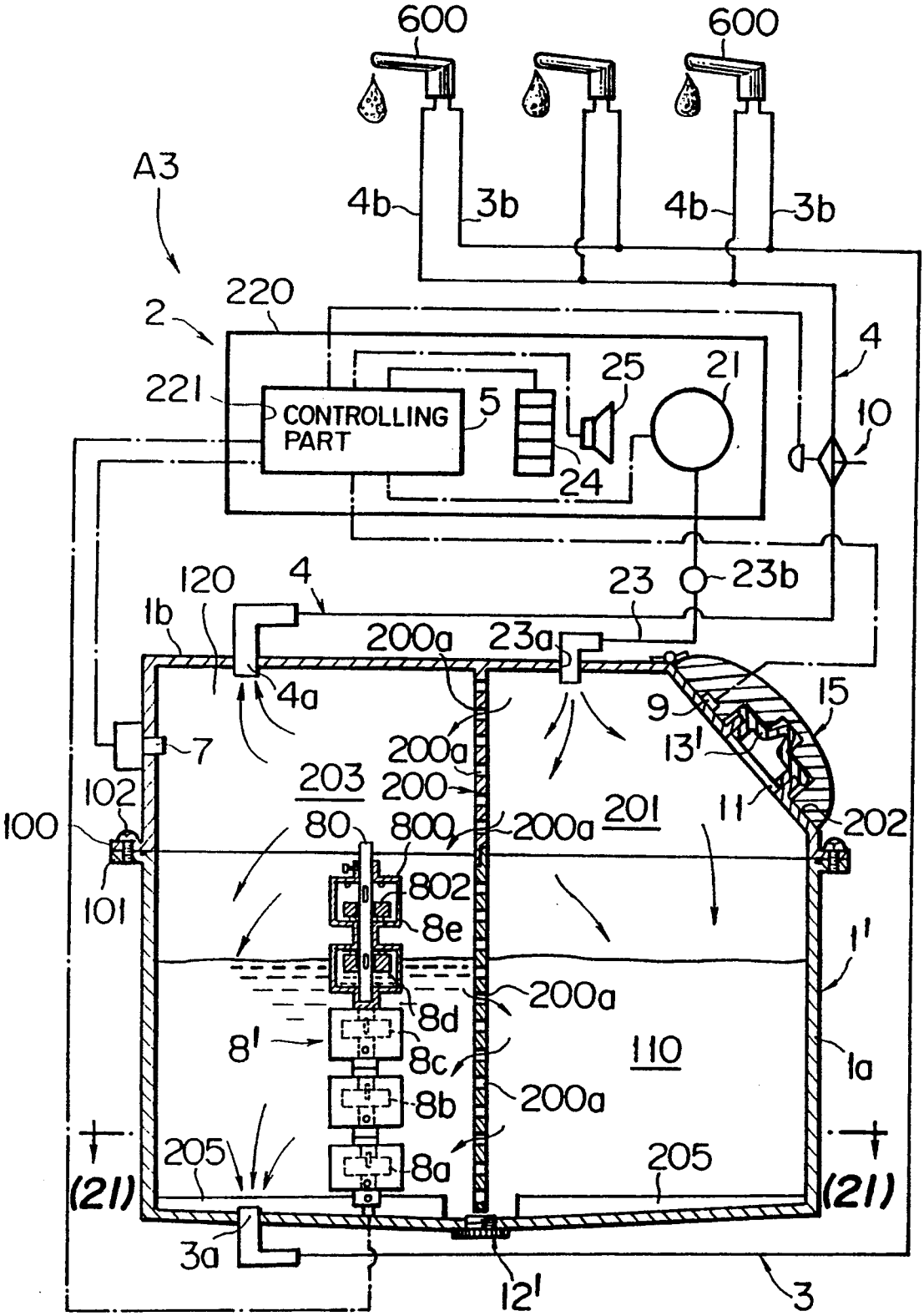
Figure 21:
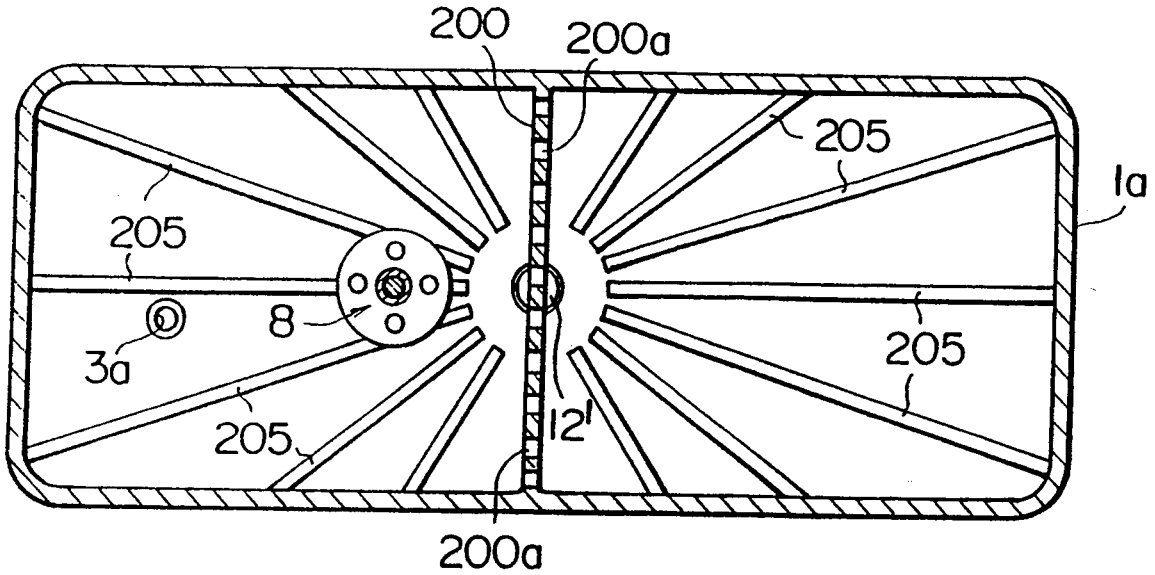
FIG. 21 is a sectional view taken along a line (21)—(21) of FIG. 20.

An inner part of the tank 1' is divided into two sections by a partition wall 200, an upper part of the side surface of the chamber 201 divided with the partition wall 200, right side portion in FIGS. 20 and 21 is formed into an inclined surface 202, a supplying port 11 is arranged in the inclined surface 202, and at the same time, the upper surface of the chamber 201 communicates with an air intake pipe 23.

The upper surface of the chamber 203 at the divided part with the partition wall 200 being an interface (left side in FIGS. 20 and 21) communicates with the air feeding pipe 4 and at the same time the lower surface communicates with the liquid soap feeding pipe 3. A pressure sensor 7 is arranged at the upper part (within the air accumulation part 120) of the chamber 203 and then the remaining volume sensor 8' is vertically arranged.

As shown in the figure, the partition wall 200 has a height ranging from an inner bottom surface of the tank 1' to the upper surface thereof, and is formed to have substantially the same width as that of the tank 1' several communication holes 200*a* having a proper diameter being formed therein. The wall is integrally formed at a substantial central part in the tank 1' or fixed by an adhesive agent and each of the chambers 201, 203 communicates with each other through the communication holes 200*a* described above.

An entire area of the communication holes 200*a* . . . of the partition wall 200 is preferably low to enable an influence of each of the chambers 201 and 203 to be reduced. However, too low an area causes an entering speed of the liquid soap or air into the adjoining chamber to be delayed to take much time for supplementary work, resulting in that it is necessary to determine the number and positions of the communication holes 200*a* and an entire area of each of the communication holes 200*a*, or the like, in view of the above.

With such an arrangement as described above, a strength of anti-pressure of the tank 1' is improved by the partition wall 200. One of the chambers divided by the partition wall 200 is provided with the liquid soap supplementing port 11 and the other chamber is provided with the pressure sensor 7, so that waves on the liquid surface during supplementing the liquid soap do not reach directly to the pressure sensor 7. Accordingly, inner pressure of the tank 1' can be detected accurately.

One chamber divided by the partition wall 200 communicates with the compressor 21 and a liquid soap supplementing port 11 and at the same time the other chamber is connected with the air feeding pipe 4, so that waves on the liquid surface during pressurizing of the tank 1' or during supplementing the liquid soap do not reach directly to the air feeding pipe 4. Thus, it is possible to prevent drawbacks in which the liquid soap enters the air feeding pipe 4 and clogs the air feeding pipe 4.

The bottom surface of tank 1' is inclined toward the drain port 12', and the drain port 12' which can be opened or closed with a lid is formed at a substantial central part thereof, and ribs 205 are radially arranged around the drain port 12'. The ribs 205 may act as guides for discharging precipitate material and the discharging of the precipitate material can be smoothly performed.

Figure 24:
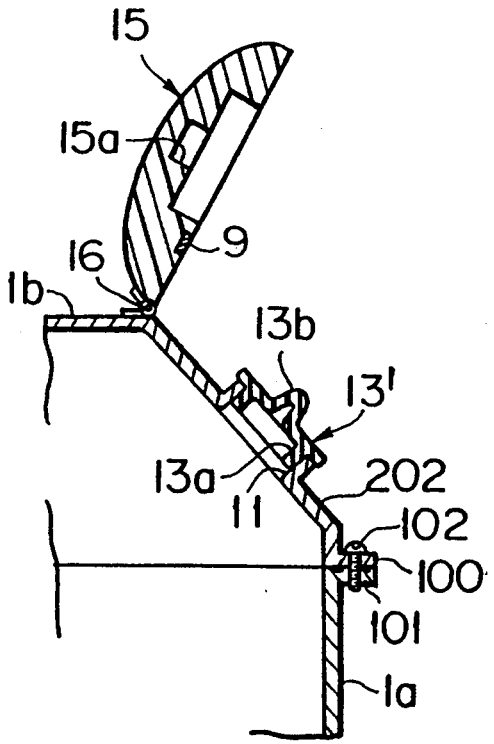
FIG. 24 is an enlarged view for showing a supplementary port in FIG. 20 to indicate the state of an opened supplementary port.

As shown in FIG. 24, the supplementing port 11 is formed to rise from the inclined surface 202 of the tank 1' in a cylindrical form and it is closed by an inner lid 13'.

The inner lid 13' is provided with an inserting cylinder 13*a* closely contacting an inner wall surface of the supplementing port 11, and the upper central part of the lid is provided with a lateral extending handle 13*b*. This inner lid 13 is covered by a lid cover 15.

The lid cover 15 is formed into a dome-shape covering an upper side of the inclined surface 202 and supported by a hinge 16 in such a way as it may be opened or closed. A bottom surface side of the lid cover 15 is provided with a fitting concave part 15*a* at its inner side to coincide with an outer surface shape of the inner lid 13'. A bottom surface of the lid cover 15 is provided with an opening or closing sensor 9 for use in detecting an opening or closing of the lid cover 15 and sending the detected signal to the control part 5.

The fitting concave part 15*a* is formed in such a manner that supplementing port 11 coincides with a shape completely sealed with the inner lid 13', thereby the lid cover 15 is not closed unless the inner lid 13' is sealingly closed, and the opening or closing sensor 9 detects an opening of the lid cover 15 and then the compressor 21 is not operated.

That is, the operation of the compressor 21 can be carried out only after the supplementing port 11 is closed and the lid cover 15 is pulled closed, and thus air leakage from the supplementing port 11 can be prevented and the possibility that the compressor 21 may operated uselessly can be prevented.

Figure 25:
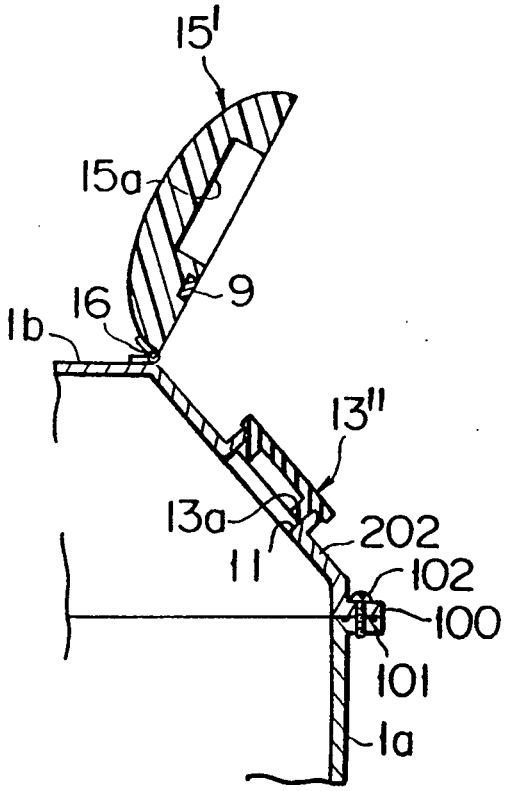
FIG. 25 is a sectional view for showing another example of a supplementary port.
Figure 26:
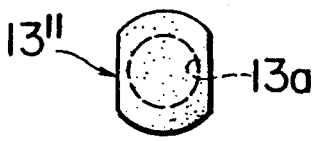
FIG. 26 is a top plan view for showing a supplementary port lid in FIG. 25.

FIGS. 25 and 26 illustrate an example of a modification of the inner lid and the lid cover described above.

The inner lid 13" illustrated in the drawing is not provided with a handle 13*b* at the inner lid 13' and at the same time its top plan view is of a shape as shown in FIG. 26 to have the right and left sides cut. The lid cover 15' is formed with a fitting concave part 15*a* coinciding with the outer shape of the inner lid 13".

Figure 27:
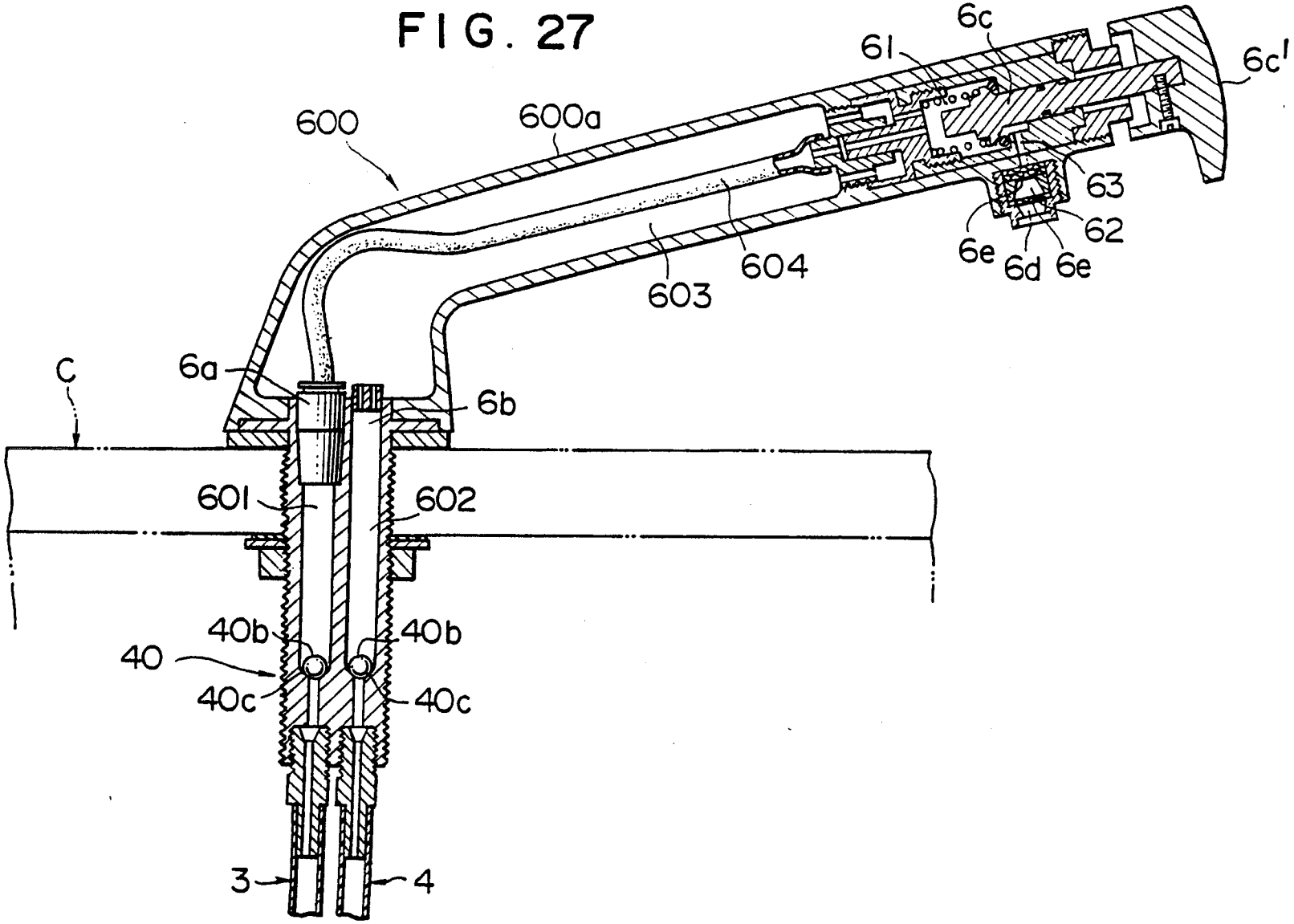
FIG. 27 is an enlarged sectional view for showing a discharging nozzle in FIG. 20.

As shown in FIG. 27, a discharging nozzle 600 has a liquid soap feeding port 6*a* and an air feeding port 6*b* at the base part of the main body 600*a*, and is further provided with a liquid soap passage 601 and an air passage 602 vertically arranged from these inlet ports 6*a* and 6*b*.

To each of the passages 601 and 602 are connected the liquid soap feeding pipe 3 and the air feeding pipe 4. Within the main body 600*a* are arranged a flow passage 603 communicating with the air feeding port 6*b*, a mixing chamber 61 communicating with the passage 603, a flow passage 604 communicating the liquid soap feeding port 6*a* with the mixing chamber 61, the aforesaid agitating chamber 62, a flow passage 63, an opening or closing valve 6*c*, a discharging port 6*d* and a strainer 63, or the like. In addition, within the aforesaid liquid soap passage 601 and the air passage 602 is arranged the aforesaid check valve 40.

Figure 28:
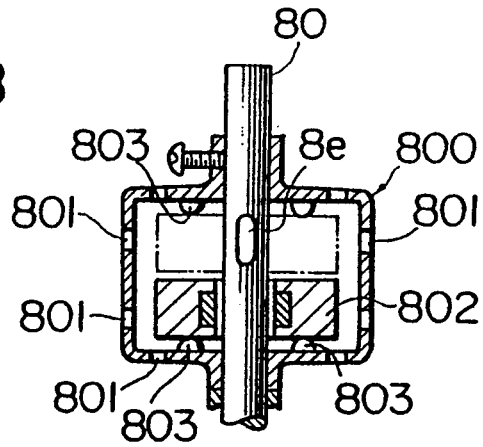
FIG. 28 is an enlarged sectional view for showing a substantial part of a remaining amount sensor in FIG. 20.

As shown in FIG. 28, the remaining volume sensor 8' is provided with a frame-like stopper 800 for every contact point (a magnetic sensing element) of the guide shaft 80. A circumferential surface of the stopper 800 is provided with through-holes 801 for use in communicating an inside and an outside of the frame body, and further, a float magnet 802 is arranged in the stopper 800 in such a manner that it may be lifted up or down. In this manner, the float magnet 802 is moved up and down in response to an increased or decreased amount of liquid soap so as to detect the remaining amount of liquid soap for every contact point 8*a* to 8*e* and to transmit each of the detected signals to the control part 5. Reference numerals 809 . . . denote projections for use in preventing a close contact of the float magnet 802.

As described above, even if the arrangement of the float magnet 802 in the frame-like float stopper 800 causes the liquid soap surface in the tank 1' to be largely oscillated, it may not directly influence the float magnet 802. Thus, this ensures that a chattering of each of the contact points (magnetic sensing elements) 8*a* to 9*e* can be prevented and no trouble may occur against the controlling operation.

The aforesaid remaining volume sensor 8' can also be applied in the aforesaid liquid soap supplying devices A1 and A2.

The casing 220 is formed of a non-metallic material such as resin, or the like, and stores the control part 5 and the compressor 21, or the like. The control part 5 is stored in a metallic shield case 221. Arrangement of the control part 5 in the shield case 221 and further arrangement in the non-metallic casing 200 may protect electronic circuits in the control part 5 against noise and external static electricity and thus it is possible to eliminate damage or runaway of the electronic circuits, or the like.

Accordingly, it is not necessary to apply an electronic component element which can withstand a high voltage and then a lower cost of an entire device can be attained.

Reference numeral 23*b* in FIG. 20 denotes an electric (electromagnetic) three-way valve arranged in the midway part of the air feeding pipe 23 and cooperatively related to the control part 5. The three-way valve may be operated when the liquid soap is discharged (when the compressor 21 is operated) or when an excessive pressure occurs within the tank 1' (when the compressor 21 is stopped) for a quite short period of time (for example, 0.1 seconds), resulting in that the valve may prohibit a possibility that the liquid soap or liquid soap bubbles, evaporating element of the liquid soap, of the like, entering through the air feeding pipe 23 to cause a trouble in the operation of the compressor 21.

Figure 29:
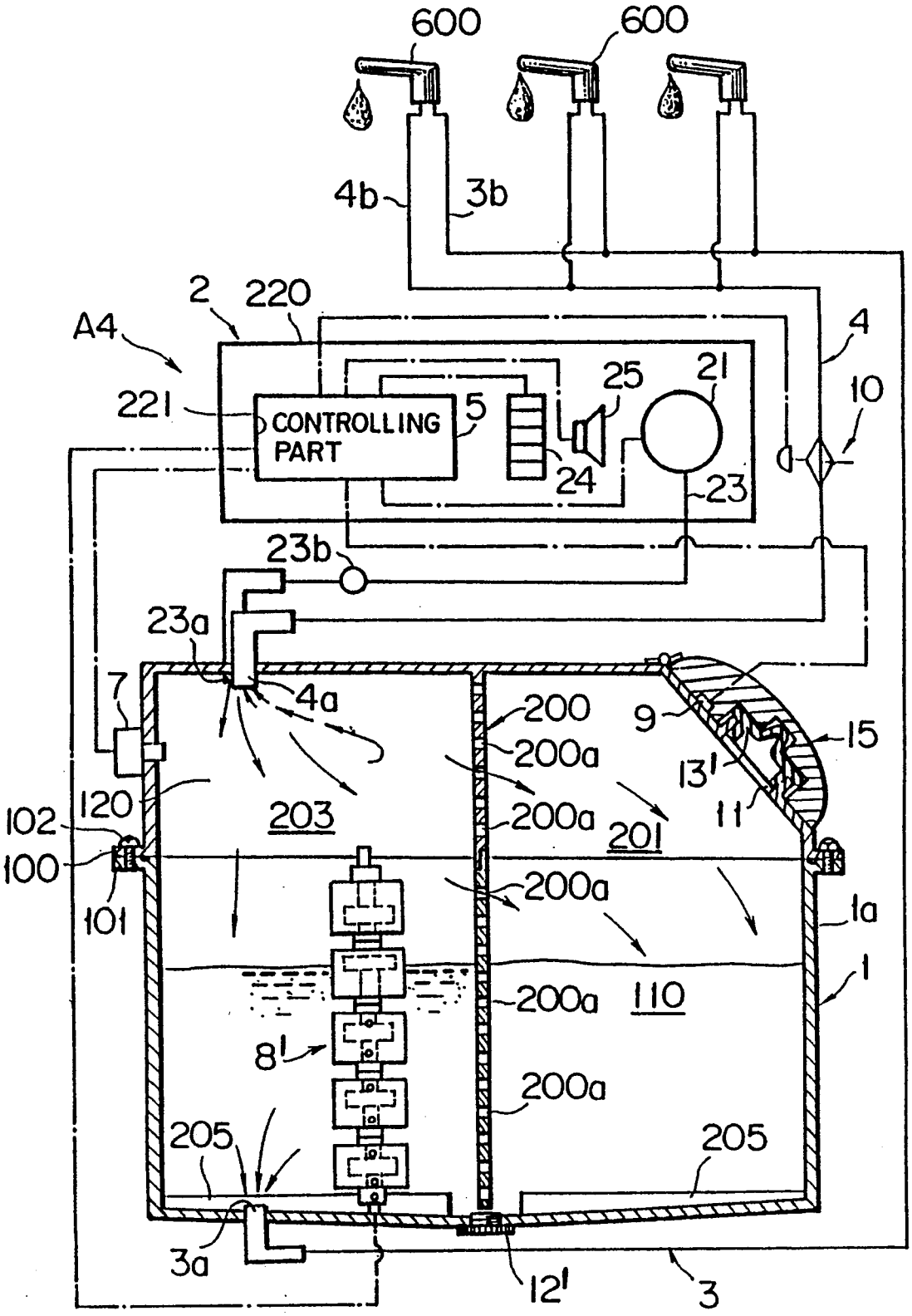

FIG. 29 illustrates a liquid soap supplying device A4 in which only the supplementing port 11 is arranged at one chamber 201 divided in the tank 1' with the partition wall 200 being interfaced, and the air feeding pipe 23 and the air feeding pipe 4 communicate with the upper surface of the other chamber 203.

According to this supplying device A4, once chamber divided by the partition wall 200 is provided with the liquid soap supplementing port 11 and at the same time the other chamber communicates with the compressor 21, so that waves on the liquid surface when the liquid soap is supplemented does not directly influence the outlet port 23*a* of the air feeding pipe 23.

Accordingly, it is possible to prevent a possibility that liquid soap or liquid soap bubbles may enter the air feeding pipe 23 to cause a trouble in the compressor 21.

Figure 30:
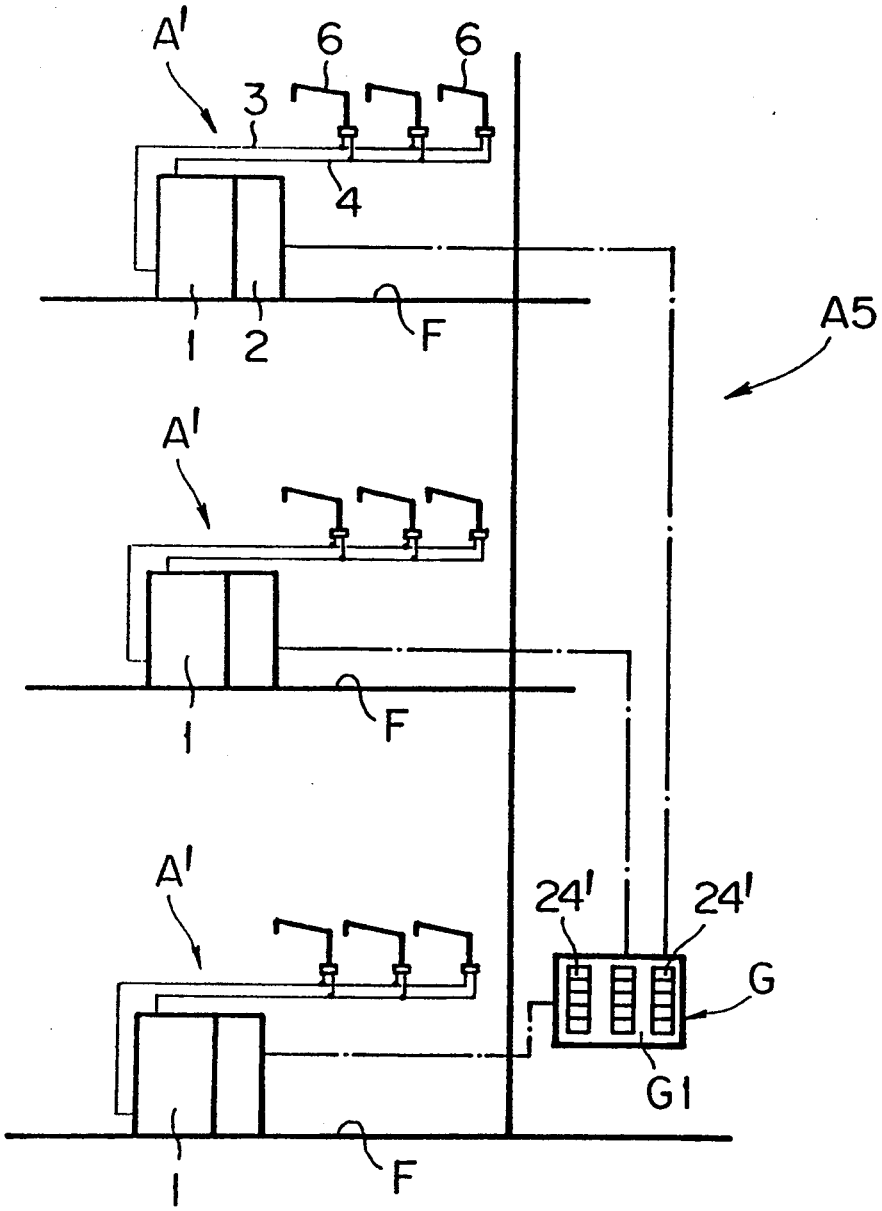
Figure 31:
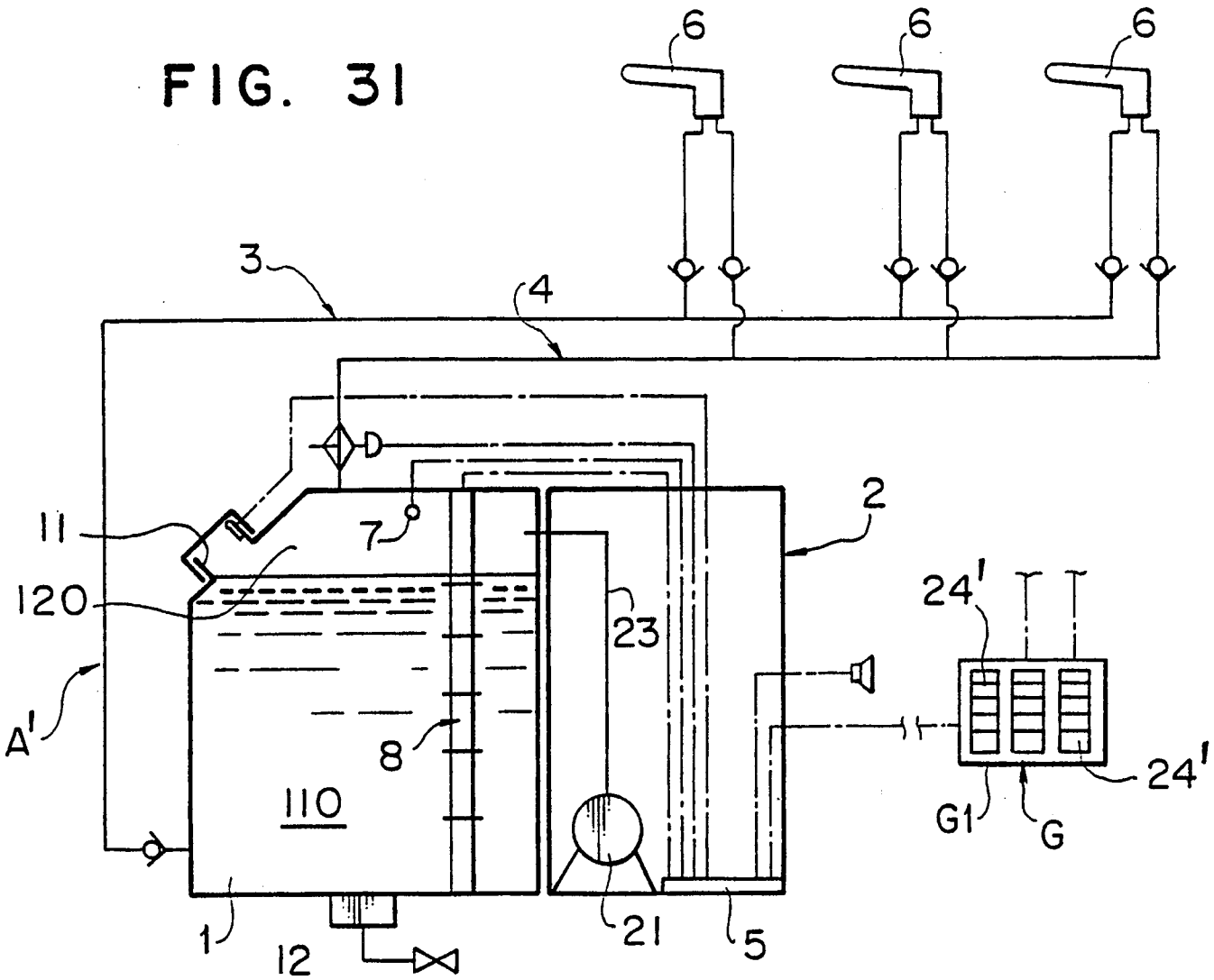
FIG. 31 is an enlarged view for showing a substantial part in FIG. 30.
Figure 32:
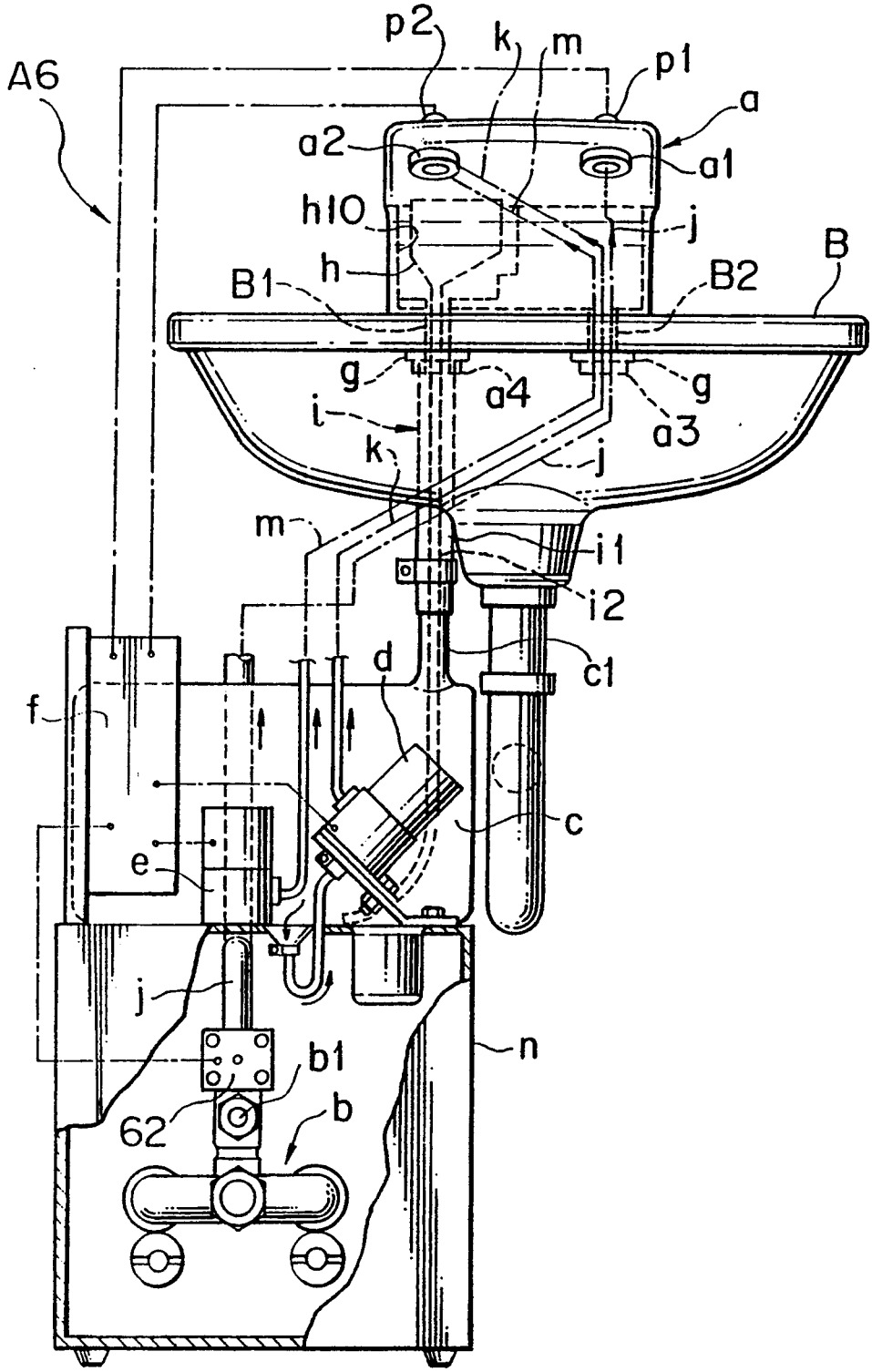
Figure 33:
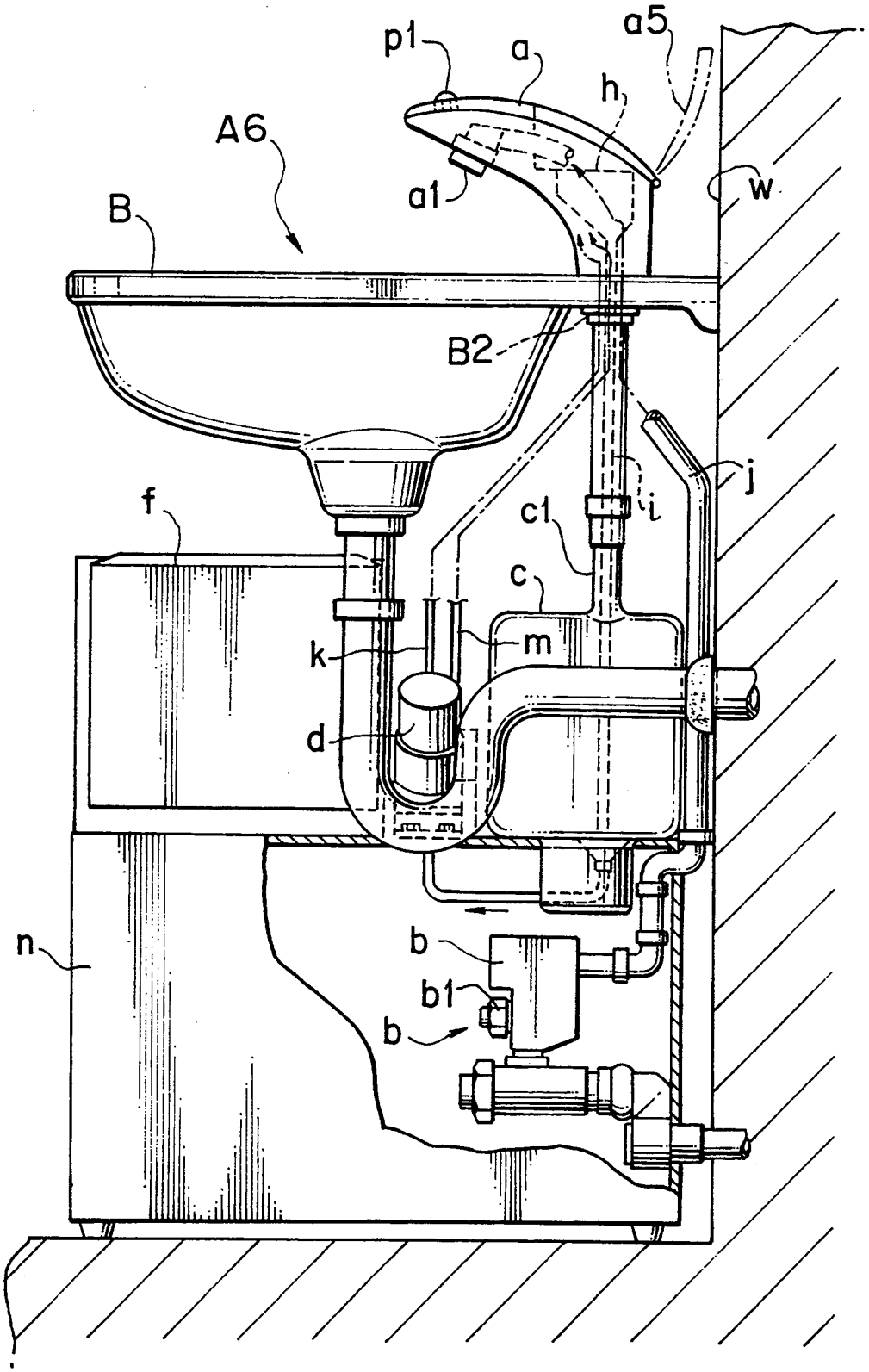
FIG. 33 is a side elevational view of FIG. 32.

FIGS. 30 and 31 illustrate a large-sized liquid soap supplying device A5 in which a liquid soap supplying part A' comprising the aforesaid tank 1 (or 1'), the pressurizing device 2, the liquid soap feeding pipe 3, the air feeding pipe 4, the control part 5, a plurality of discharging nozzles 6 (or 6', 6'', 600), the pressure sensor 7, the remaining volume sensor 8 (or 8') is mounted for every floor F in an office building, or the like, or in other suitable locations, and at the same time the displaying function part G having each of the remaining volume displaying parts 24' at each of the liquid soap supplying parts A' is provided.

The displaying function part G is provided with a discrete remaining volume displaying part 24' corresponding to each of the liquid soap supplying parts A' in a single panel G1. Each of the remaining volume displaying parts 24' communicates with each of the control parts 5 for cooperating with the remaining volume sensor 8 in each of the liquid soap supplying parts A'. It may display through an LED display, in a step-wise manner, the remaining volume of the liquid soap 110 within each of the tanks 1 in response to each of the control parts 5.

Each of the remaining volume displaying parts 24' may display a full charged state of the tank 1 when all LED displays are lit and display a vacant state when all LED displays are diminished. When the remaining volume sensor 8 detects the lower-most level (8*a*) of the remaining volume of liquid soap, the LED display is illuminated and all the displaying functions of the aforesaid remaining volume displaying part 24 are included.

According to the liquid soap supplying device A5, since the remaining volume of the liquid soap 110 in each of the tanks 1 in a plurality of liquid soap supplying parts A' is displayed at the single displaying function part G, the remaining volume of the liquid soap at each of the liquid soap supplying parts A' installed at each of the floors F, or the like, can be confirmed at a glance.

Accordingly, it is not necessary to perform a periodical round-check for each of the liquid soap supplying parts A' on purpose, so that its supervising operation may easily be carried out and labor of a supervisor can be reduced. In addition, since the remaining volume of the liquid soap at each of the liquid soap supplying parts A' can be frequently confirmed, a supplementing time for the liquid soap can be seen at an early and convenient time.

A liquid soap supplying device A6 shown in FIGS. 32 to 36 is operated such that a supplying of the liquid soap and air is carried out by a pump. A water spigot main body (a) is attached and fixed to the upper surface of the basin B mounted at the wall surface W in a restroom, or the like, and at the same time within the lower spacing of the aforesaid basin B, a hot water and cold water mixing spigot (b), a liquid soap tank (c), a liquid soap pump (d), an air pump (e) and a control part (f), or the like, are fixed and attached to a base block (n).

The basin B is an already existing product in which the two fixing ports B1 and B2 are arranged at the upper surface of the bowl part at the wall surface W at a predetermined spacing, for example, the openings having a diameter of 28 mm are spaced apart by a spacing of 102 mm.

Figure 34:
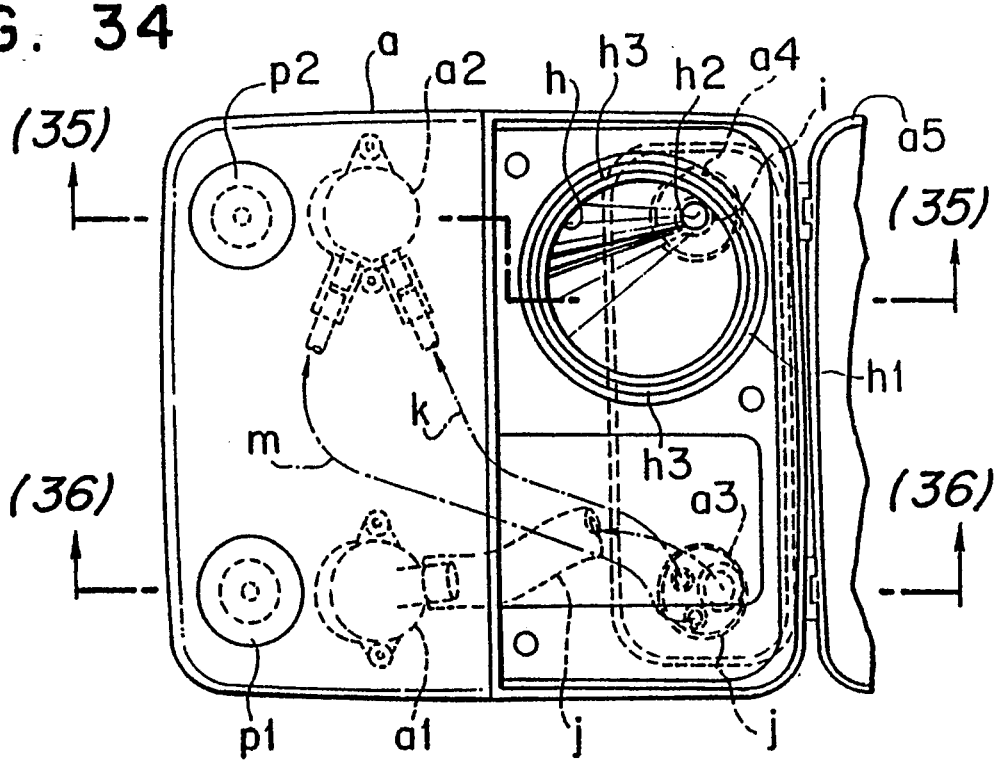
FIG. 34 is a top plan view for showing a substantial part of FIG. 33.
Figure 35:
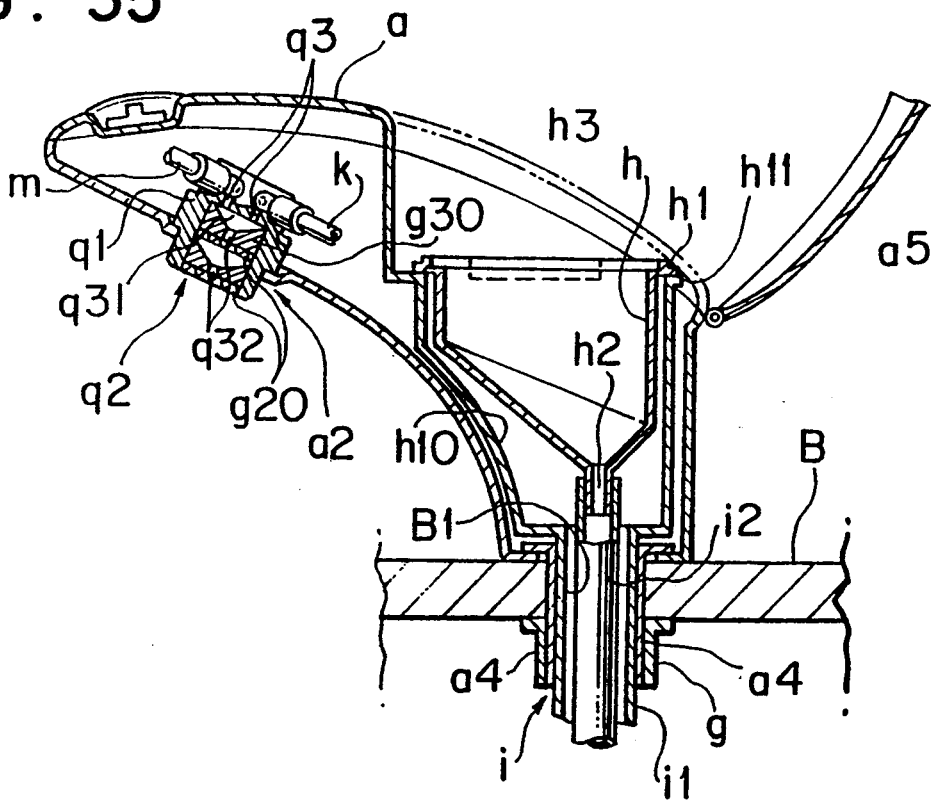
FIG. 35 is a sectional view taken along a line (35)—(35) of FIG. 34.
Figure 36:
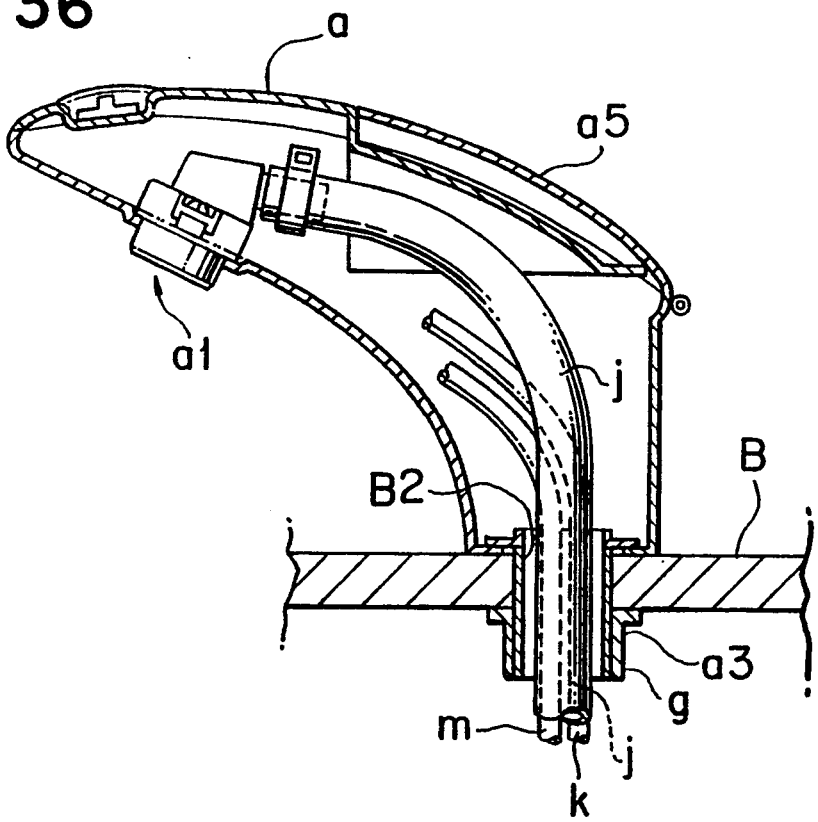
FIG. 36 is a sectional view taken along a line (36)—(36) of FIG. 34.

As shown in FIGS. 34, 35 and 36, the water spigot main body (a) is hollow and formed in a wide width, and the water discharging port a1 and the liquid water discharging port a2 adjacent to the bowl of the basin B are arranged side-by-side at the upper part of the main body. In addition, the bottom surface of the water spigot main body (a) is formed with the two connection ports a3 and a4 in compliance with the spacing between the fixing ports B1 and B2 mounted in the basin B.

The water spigot main body (a) is provided with the aforesaid connection ports a3 and a4, thereby the water spigot main body can be fixed to an already installed basin B having the two fixing ports B1 and B2 arranged at a predetermined spacing.

Both connection ports a3 and a4 of the water spigot main body (a) are fitted to the fixing ports B1 and B2 of the basin B and fastened with nut (g) from the lower surface side, thereby when the water spigot main body (a) is attached and fixed, the aforesaid connection ports a3 and a4 may form a passage communicating the interior part of the water spigot main body (a) with the lower spacing of the basin B.

As shown in FIG. 35, an interior part of a door a5 arranged at the upper part of the water spigot main body (a) is provided with a supplementing port (h) communicating with a liquid soap tank (c). The supplementing port (h) and the upper port c1 of the liquid soap tank (c) mounted at the lower part of the basin B are connected by a supplementing pipe (i) to be described later. In the conventional system, the supplemental port (h) for the liquid soap described above was directly arranged at the liquid soap tank (c). Accordingly, in the case that the liquid soap is to be supplemented, liquid soap should be directly supplemented into the liquid soap tank below the basin B. However, as described above, the arrangement of the liquid soap supplementing port (h) in the water spigot main body (a) enables the liquid soap to be easily supplemented through the supplementing port (h) arranged on the basin B without requiring a difficult position for the work.

A water supplying pipe (j) is connected to the water discharging port al of the water spigot main body (a), and each of a liquid feeding pipe (k) and an air pipe (m) is connected to the liquid soap discharging port a2 from an inside part of the main body (a), respectively, and these pipes (j), (k), (m) pass through the other connection port a3 and are arranged toward the lower part of the basin B. The water supplying pipe (j) arranged at the lower part of the basin B is connected to the secondary side of the hot water and cold water mixing spigot (b), and the liquid feeding pipe (k) and the air pipe (m) are connected to the secondary connection ports of the liquid soap pump (d), and the air pump (e) communicates with the liquid soap tank (c), respectively.

As shown in FIG. 35, the aforesaid liquid soap discharging port a2 is made such that a cylindrical case q1 having an opened bottom surface is inserted and fixed at an extreme end part of the water spigot main body (a), and a mixing chamber q2 is formed in the case q1. On the upper surface of the case q1 is arranged a communicating passage q3 which communicates with the mixing chamber q2 and to which the liquid feeding pipe (k) and the air pipe (m) are connected.

The mixing chamber q2 has strainers q20 and q20 within the case q1 in a properly spaced-apart relation, and at the upper surface side of each of the strainers q20 are installed the mixing members q30 provided with concave parts q31 having a funnel-like section and through-pass holes q32 opened at the deepest portion of the concave part q31.

The liquid soap and air flowing through the communication passages q3 and q3 are agitated and mixed by the mixing member q30 and the strainer q20 ( upstream side ) and further repeatedly agitated and mixed by the mixing member q30 and the strainer q20 at the lower (downstream) side, thereby a fine and smooth-like liquid soap similar to that of the arrangement of several (normally 5 to 6 pieces) strainers overlapped to each other can be attained. Concurrently, it is also possible to prevent clogging which is apt to occur in the case that several strainers are overlapped to each other.

The aforesaid supplementing pipe (i) is constructed as a double-pipe structure comprising an outer pipe I1 and an inner pipe 12.

The outer pipe i1 is constructed such that its upper end is connected to a connection port a4 of the water spigot main body (a). The outer pipe projects downwardly, passes through the fixing port B1, extends into the spacing below the basin B and is connected to the upper port c1 of the liquid soap tank (c).

The inner pipe i2 is inserted into the outer pipe i1 with a slight clearance being left between it and the inner circumferential surface of the outer pipe i1, passes through the upper port c1 and is inserted up to a part near the bottom part in the liquid soap tank (c). The upper end of the inner pipe i2 is connected to the supplementing port (h).

Accordingly, the supplementing pipe (i) may constitute the liquid soap supplementing passage in the inner pipe i2, resulting in that a spacing between the inner pipe i2 and the outer pipe i1 may constitute an air-releasing passage for releasing air from the liquid soap tank (c).

A concave part h10 communicating with the connection port a4 is arranged within the water spigot main body (a), and the supplementing port (h) is arranged in the concave part h10. The upper end of the outer pipe i1 communicates with the concave part h10.

As shown in FIG. 35, the supplementing port (h) is formed into a funnel shape having a flange h1 at an upper opening edge, the flange h1 engages the upper end opening edge h11 of the concave part 10 and is arranged in the concave part h10. Then the upper end of the inner pipe 12 is connected to the feeding port h2 opened from the bottom part of the concave part in its projected form.

The flange h1 of the aforesaid supplementing port (h) is formed with recesses h3 and the air releasing passage communicates with an external side through the recesses h3.

The hot water and cold water mixing spigot (b) is a well-known unit for use in mixing hot water and cold water up to a set temperature under an operation of a temperature setting handle, in which the water supplying pipe (j) is connected to its discharging port and there is provided an opening or closing valve b1 to be opened or closed under an operation of a user and an electromagnetic valve b2 to be opened or closed under an instruction from the control part (f).

Each of the touch switches p1 and p2 are arranged just above the water discharging port a1 and the liquid water discharging port a2 in the water spigot main body (a). These touch switches are connected to the control part (f) mounted on the base block (n).

The control part (f) is electrically connected to the electromagnetic valve b2 of the hot water and cold water mixing spigot (b), the liquid soap pump (d) and an air pump (e) in the same manner as both of the aforesaid touch switches p1 and p2.

Figure 37:
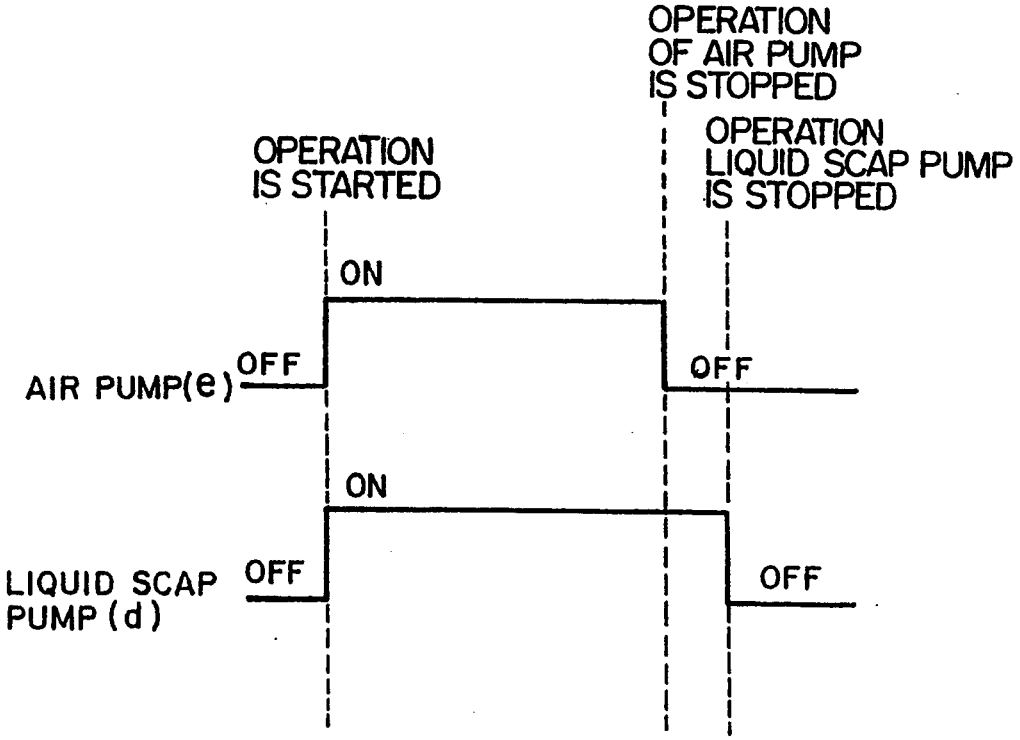
FIG. 37 is a time chart for an operation of a pump in the liquid soap supplying device shown in FIG. 32.

The control part (f) may open the electromagnetic valve b2 in response to the pushing of the touch switches p1 and p2, supply water to the water discharging port a1, operate the liquid soap pump (d) and the air pump (e) and concurrently supply the liquid soap and the air to the liquid soap discharging port a2. As shown in FIG. 37, the control part (f) is provided with means for operating the liquid soap pump (d) and the air pump (e), stopping the air pump at first after a predetermined time has elapsed and further stopping the liquid soap pump (d) after a further predetermined time has elapsed.

Accordingly, in case of the aforesaid water spigot, a pushing of the touch switch p1 causes either water or mixed water of a predetermined temperature to be discharged/stopped through the water discharging port a1, and another pushing of the touch switch p2 causes the bubbled liquid soap to be discharged/stopped through the liquid soap discharging port a2.

The liquid soap supplying device A6 described above enables the water spigot main body (a) to be fixed to the already installed basin B and further to enable the pipes (i), (j), (k) and (m) for water feeding or liquid soap to be attained. Accordingly, the device may easily be mounted in place of the water spigot installed in an already set basin B in a home, for example, and thus the water supplying function as well as the liquid soap supplying function may easily be utilized.

In addition, since the water discharging port a1 and liquid soap discharging ports a2 and a2′ are arranged in the water spigot main body (a), a comparison of the present invention with the prior art system in which the water discharging port and the liquid soap discharging port project from the device in a side-by-side relation shows that the arrangement of the water discharging fittings for the basin B can be arranged well and its cleaning may easily be carried out.

In the aforesaid liquid soap discharging device A6, if the lid a5 of the water spigot main body (a) is opened to feed liquid water into the supplementing port (h), the liquid water is fed to the bottom part of the liquid soap tank (c) through the liquid soap supplementing passage comprised of the inner pipe i2 of the supplementing pipe (i), and as the amount of liquid soap in the tank (c) is increased, the air in the tank (c) is discharged out of the tank (c) through the air releasing passage formed by the clearance between the inner pipe i2 and the outer pipe i1 of the supplementing pipe (i), resulting in that the air and the liquid soap are replaced by each other. Thus, in the case that the liquid soap is supplemented into the liquid water tank, the replacement of air and liquid soap in the tank is carried out well and then occurrence of bubbles is restricted.

Accordingly, in the present invention, there occurs no drawbacks that the bubbles are forced out of the liquid soap supplementing port and troublesome operation for supplementing a small amount of liquid soap little by little so as not to make any bubbles, resulting in that the liquid soap supplementing work can be carried out easily within a short period of time.

In addition, according to the aforesaid liquid soap supplying device A6, a user operates the touch switch p2 to cause the bubbled liquid soap to be discharged from the liquid soap discharging port a2 for a specified period of time and subsequently the liquid soap is discharged so as to flush away the bubbled liquid soap left in the discharging port a2. Thus, there is no possibility that the liquid soap is left in the mixing chamber q2, and further, it is possible to prevent a drawback that the liquid soap is dried and clogs the discharging port a2.

In the aforesaid liquid soap supplying device A6, it is apparent that a photoelectrical human body sensor, for example, of non-touch type can be utilized in place of the touch switches p1 and p2.

What is claimed is:

1. A liquid soap supplying device comprising:
- a tank for storing liquid soap having an air accumulation part being located at an inner upper part of said tank;
- a pressurizing device arranged to communicate with said air accumulation part;
- a pressure sensor arranged at said air accumulation part;
- a control part for controlling operation of said pressurizing device in response to a sensing signal from said pressure sensor and for controlling pressure of said tank to a predetermined pressure;
- a liquid soap feeding pipe at a bottom part of said tank;
- an air feeding pipe at said air accumulation part;
- a discharging nozzle provided with a mixing chamber for liquid soap and air, and communicating with the liquid soap feeding pipe and the air feeding pipe;
- an opening and closing valve for controlling discharge of combined air and liquid soap from said discharging nozzle; and
- a liquid soap supplementing port arranged at the tank, said liquid soap supplementing port being provided with an opening and closing sensor for sensing an opening or closing said supplementing port, and the control part being provided with controlling means for stopping an operation of the pressurizing device when said opening and closing sensor detects an opened supplementing port.

2. A liquid soap supplying device according to claim 1, further comprising an inner lid for opening and closing the supplementing port, and a lid cover for covering said inner lid in such a manner that the inner lid may be opened or closed, and an opening and closing sensor for sensing an opening or closing of said lid cover.

* * * * *